US006325725B1

(12) United States Patent
Tsujita

(10) Patent No.: US 6,325,725 B1
(45) Date of Patent: Dec. 4, 2001

(54) BOWLING ALLEY MANAGEMENT SYSTEM

(75) Inventor: Masahiro Tsujita, Osaka (JP)

(73) Assignee: Telesystems Co., Ltd., Osaka (JP)

( * ) Notice: Subject to any disclaimer, the term of this patent is extended or adjusted under 35 U.S.C. 154(b) by 0 days.

(21) Appl. No.: 09/078,334

(22) Filed: May 13, 1998

(30) Foreign Application Priority Data

May 19, 1997 (JP) ..... 9-128580

(51) Int. Cl.[7] ..... A63F 9/22

(52) U.S. Cl. ..... 473/70; 473/54; 473/65; 700/91; 700/92; 700/93

(58) Field of Search ..... 434/249; 473/54, 473/64–69, 70–72; 700/91–93

(56) References Cited

U.S. PATENT DOCUMENTS 4,572,509 * 2/1986 Sitrick ..... 273/85 G
4,710,873 * 12/1987 Breslow et al. ..... 364/410
4,827,412 * 5/1989 Form ..... 364/410
5,241,379 * 8/1993 Tsujita ..... 358/93
5,595,389 * 1/1997 Parulski et al. ..... 463/31
5,709,607 * 1/1998 Mowers et al. ..... 473/58
5,810,665 * 9/1998 Takemoto et al. ..... 463/31
5,842,929 * 12/1998 Moody et al. ..... 473/70

* cited by examiner

*Primary Examiner*—Jessica J. Harrison
*Assistant Examiner*—Carmen D. White
(74) *Attorney, Agent, or Firm*—Pillsbury Winthrop LLP

(57) ABSTRACT

Information-compressed image data is generated or inputted in an office unit 3. Control data and image data is transferred to specified consoles 1*a*–1*m* according to reproduction timing or reproduction procedure for the image data. Each console expands the information-compressed image data and displays an image of the data on overhead CRTs 4*a*, 5*a*, . . . 4*m*, 5*m*.

7 Claims, 25 Drawing Sheets

FIG.8

<AUTOMATIC REPRODUCTION SETTING TABLE>

| No. | DATE | SCHEDULE NAME | REMARKS |
|---|---|---|---|
| 1 | 97/ 4/ 6 | SCH1 | COMPETITION |
| 2 | 97/ 4/ 7 | SCH3 | COMPETITION |
| 3 | 97/ 4/12 | SCH2 | PROFESSIONAL LEAGUE |
| 4 | 97/ 4/13 | SCH0 | PROFESSIONAL LEAGUE |
| ⋮ | ⋮ | ⋮ | ⋮ |
| | WEEKDAY | SCHwk | |
| | SATURDAY | SCHsa | |
| | SUNDAY | SCHsu | |
| | HOLIDAY 1 | SCHfe1 | |
| | HOLIDAY 2 | SCHfe2 | |
| | HOLIDAY 3 | SCHfe3 | |
| | ⋮ | ⋮ | |

FIG.9

<SCHEDULE TABLE>

| NAME | TIME | COMMAND | PARAMETER |
|---|---|---|---|
| SCH1 | 09:00<br>09:10<br>09:20<br>⋮ | SUB1<br>SUB4<br>SUB2<br>⋮ | 5 |
| SCH2 | 09:00<br>10:00<br>10:20<br>⋮ | SUB1<br>SUB2<br>SUB5<br>⋮ | 1H |
| SCH3 | 09:00<br>09:10<br>09:20<br>⋮ | SUB6<br>SUB2<br>SUB3<br>⋮ | 40M |
| ⋮ | ⋮ | ⋮ | |
| SUB1 | | MPEG<br>MPEG<br>MPEG | 101<br>102<br>103 |
| SUB2 | | MPEG<br>MPEG | 201<br>202 |
| SUB3 | | LOOP:JPEG<br>JPEG<br>JPEG<br>GOTO LOOP | 301<br>302<br>303 |
| ⋮ | | ⋮ | ⋮ |

FIG.12

<COMMERCIAL TABLE>

| COMMERCIAL NUMBER | REPRODUCTION FILE | PARAMETER |
|---|---|---|
| 1 | JPEGx1,MIDIx1<br>JPEGx2,MIDIx2<br>JPEGx3,MIDIx3<br>JPEGy1,MIDIy1<br>JPEGy2,MIDIy2 | 5S<br>5S<br>5S<br>10S<br>10S |
| 2 | MPEGa<br>MPEGb<br>MPEGc | |
| 3 | MPEGx1<br>MPEGx2<br>MPEGx3 | |
| ⋮ | ⋮ | ⋮ |

<CONSOLE>

FIG.17

<MEMBER MASTER FILE>

| MEMBER NO. | NAME | DATE OF BIRTH | HANDICAP | IMAGE FILE |
|---|---|---|---|---|
| 101 | NAOKO SHIMADA | 70/ 4/ 6 | 5 | file-101 (FOR STRIKE)<br>file-102 (FOR SPARE)<br>file-103 (FOR ONE-PIN LEFT)<br>file-104 (FOR GUTTER) |
| 102 | TAKESHI NAKAO | 79/10/25 | 13 | file-201 (FOR STRIKE)<br>file-202 (FOR SPARE)<br>file-203 (FOR ONE-PIN LEFT)<br>file-204 (FOR GUTTER) |
| 103 | KOICHI MATSUYAMA | 81/08/ 3 | 10 | file-301 (FOR STRIKE)<br>file-302 (FOR SPARE)<br>file-303 (FOR ONE-PIN LEFT)<br>file-304 (FOR GUTTER) |
| ⋮ | ⋮ | ⋮ | ⋮ | ⋮ |

(A)

(B)

(A)

(B)

BOWLING ALLEY MANAGEMENT SYSTEM

FIELD OF THE INVENTION

The present invention relates to consoles for bowling provided on the lane side and a bowling alley management system comprising these consoles and a host computer.

PRIOR ART

In a conventional common bowling alley, there has been constructed a bowling alley management system in which consoles for counting the bowling score by detecting the pin state after a bowl are provided on the lane side while a host computer is provided on the front side so as to allow data transmission to be performed with each of the consoles.

With such a bowling alley management system, affairs required of front clerks are saved and bowlers are allowed to devote themselves to the bowling game, so that the bowling alley can run smoothly with improved rate of turnover as its advantages.

Also, on CRTs or overhead CRTs provided in the consoles, score display is presented and moreover another game other than the bowling game is displayed at specified timing. Thus, it is devised that new services are offered to bowlers.

With the conventional bowling-use consoles and bowling alley management system, the bowling game runs smoothly on the whole with an improved rate of turnover of the bowling alley. As a result, the management efficiency is enhanced for the bowling alley side, while the addition of another game or the like makes the bowling game and the bowling alley more attractive for bowlers.

However, in such a conventional bowling alley management system, since a video reproducing device such as an LD (Laser Disc) device is connected to each overhead CRT only via one video cable, the display of a reproduced signal would be such that an identical image is displayed on selected overhead CRTs at the same time. This makes it impossible to display images of an abundance of information to bowlers and customers, so that the display devices connected to the consoles would not necessarily be put into effective use as an image display device.

Also, in the conventional console for bowling, it has been practiced to display a predetermined character in animation on the display device with specified timing, for example, as a praising display upon the occurrence of a strike or the like, in addition to the score display. However, since animation patterns of the character are limited, it would be rather bored.

An object of the present invention is therefore to add new attractivenesses to bowling alleys by allowing the display device connected to or built in the console to be put into effective use as an information offering means for bowlers or customers.

Another object of the present invention is to add new attractivenesses to bowling alleys and consoles for bowling by enhancing bowlers' consciousness of participating in the bowling game.

SUMMARY OF THE INVENTION

According to the present invention, there is provided a bowling alley management system comprising: a bowling alley management system comprising console devices provided in each lane and a host computer connected to the console devices via a local area network, each of the console devices comprising:

a pin detecting device for detecting a pin state of pins' set positions after a bowl, and counting means for counting a bowling game score from the pin state;

the host computer comprising compressed image memory for storing image data subjected to data compression, and transfer means for transferring the image data to any of the console devices via the local area network, wherein the console device further comprises data expansion means for receiving the image data and expanding the data, and a display device for displaying reproduction image obtained by the data expansion.

With this bowling alley management system, different images can be displayed on the display devices built in or connected to a plurality of consoles installed in the bowling alley without using any video cable. For example, it becomes possible to display commercials, BGV (BackGround Video) or other images.

Also, according to the present invention, there is provided a console device provided in each lane and connected to a host computer via a local area network, comprising:

bowler's image memory for storing bowler's image information including an image of a bowler's face; and display means for reading and displaying the bowlers' image information based on occurrence of a specified event during a bowling game.

With this console device, a bowler's image can be displayed out of the bowler's image information in response to occurrence of an event of a strike, a spare or a bowler's bowl, so that an unboring display can be presented as a display other than the score display. Further, when the bowler's image information is provided by images picked up by the video camera, it becomes possible to generate bowler's image information at any necessary time point.

Further, when the bowler's image information is provided by modifying the bowler's original image, it becomes possible to display a smiling face for the occurrence of a strike, a regretful face for the occurrence of a one-pin left, or the like, switchably.

BRIEF DESCRIPTION OF THE DRAWINGS

FIG. 8 is a view showing an example of the automatic reproduction setting table;

FIG. 9 is a view showing an example of the schedule table;

FIG. 12 is a flow chart showing the contents of data transfer process in the console;

FIG. 17 is a view showing an example of the member master file;

DETAILED DESCRIPTION OF THE PREFERRED EMBODIMENTS

The configuration of a bowling alley management system which is a first embodiment of the present invention is described with reference to FIGS. 1 to 9.

Figure 1:
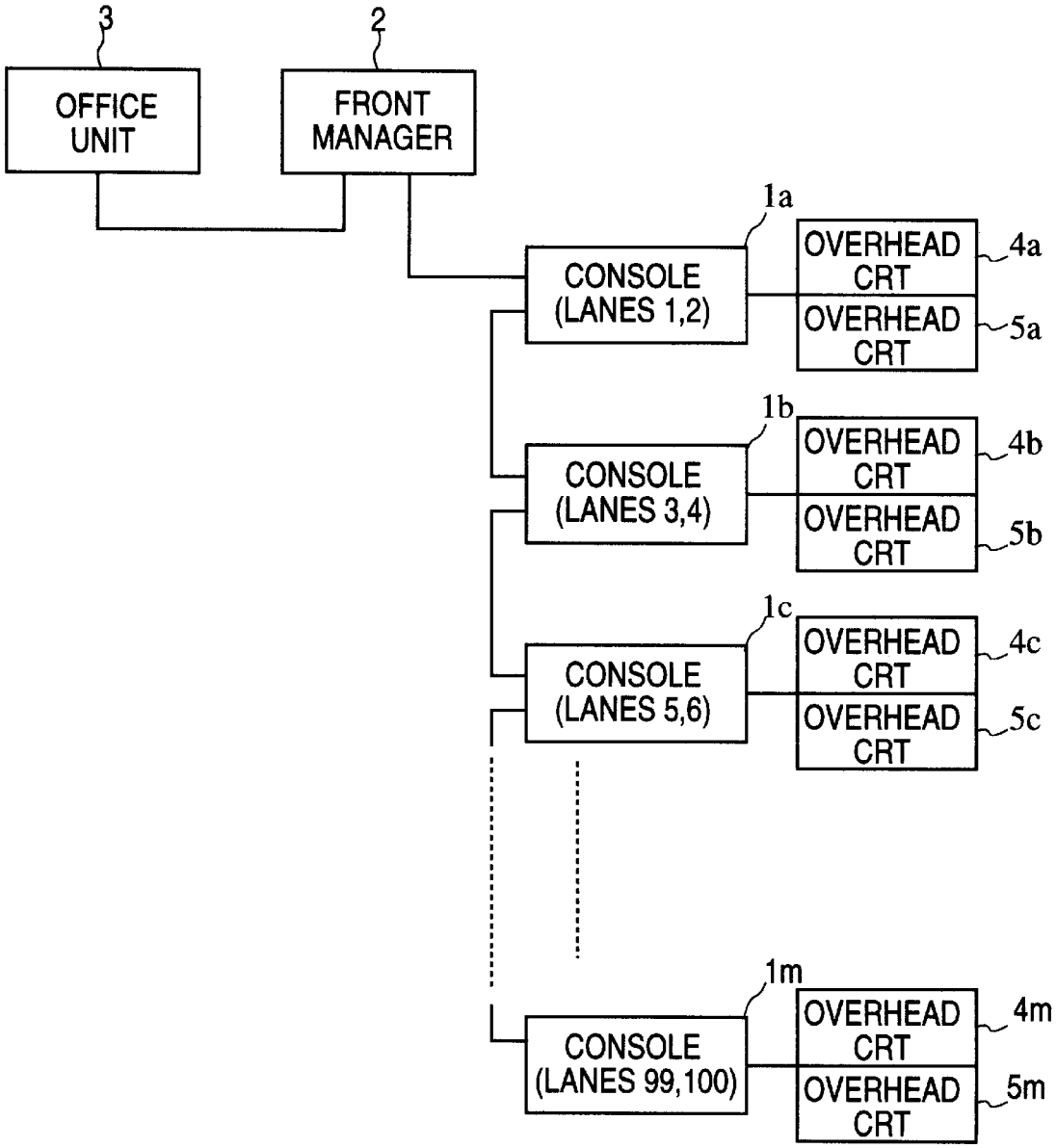
FIG. 1 is a block diagram showing the whole configuration of the bowling alley management system.

FIG. 1 is a block diagram showing the configuration of the whole bowling alley management system. In this example, an office unit 3 provided in the office, a front manager provided at the front and a plurality of consoles 1*a*, 1*b*, . . . , 5*m* provided one for every two lanes are connected together via a local area network 42. In this case, the office unit 3 and the front manager 2 correspond to a host computer according to the present invention.

Figure 2:
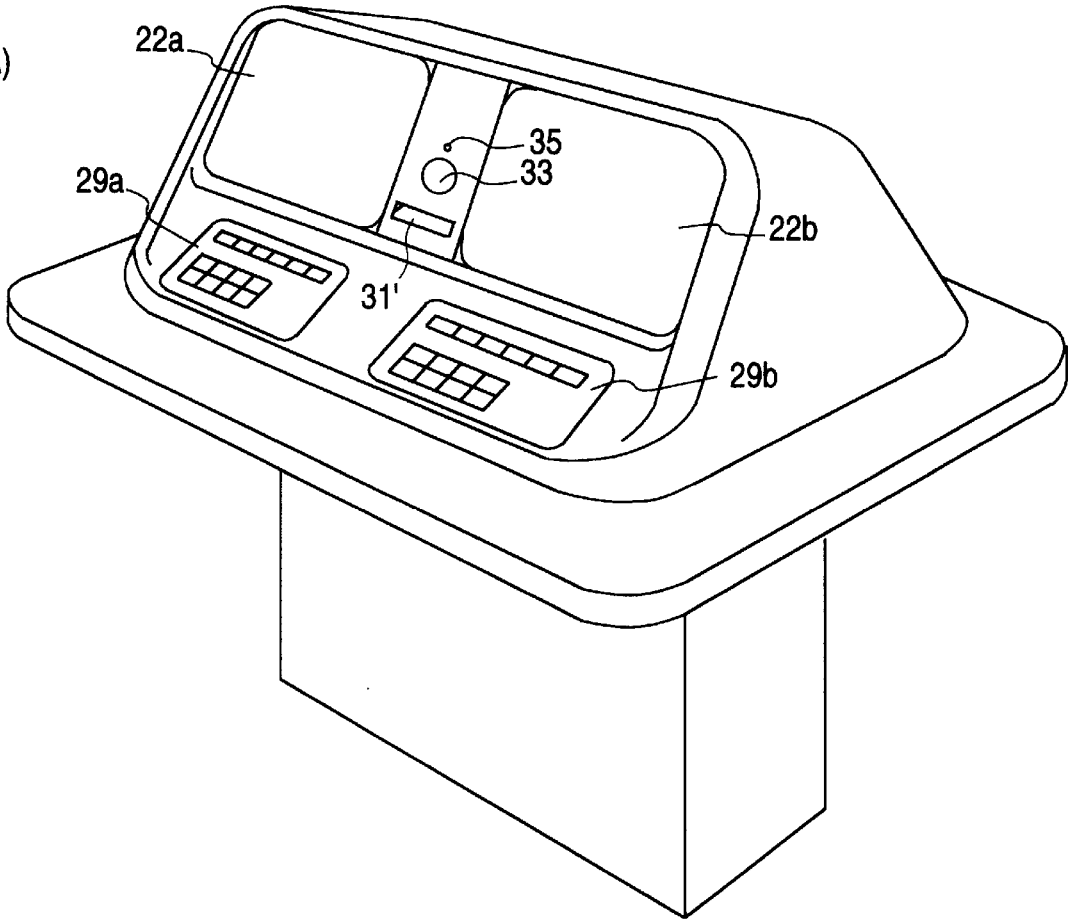
FIG. 2 is an appearance perspective view of the console.
Figure 2:
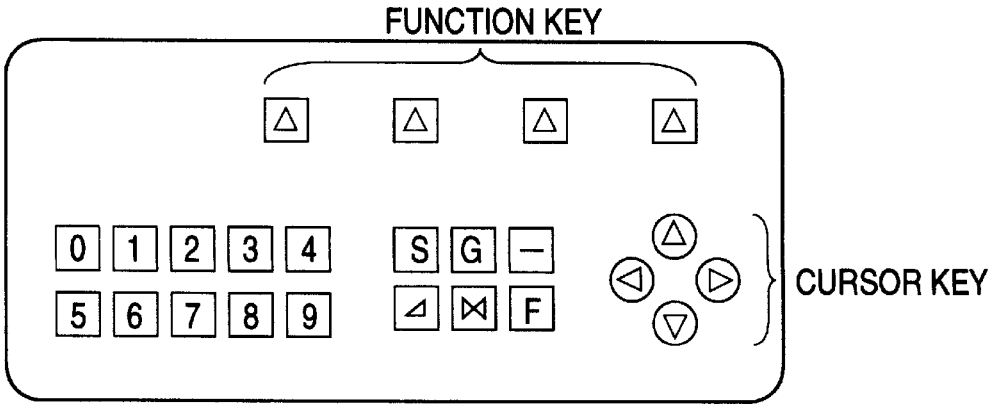

FIG. 2 is an appearance perspective view showing the configuration of the console. Referring to FIG. 2, numerals 22*a*, 22*b* each denote a CRT for performing score display and image display, and numerals 29*a*, 29*b* each denote a keyboard used for the entry of bowler's names, the correction of score and the processing of print. Numeral 31' denotes a printer discharge hole, through which a printing result is put out in printing operation. Numeral 33 denotes a video camera (window) for picking up an image of the forward of the console, and picks up an image of the bowler placed before the console. Denoted by numeral 35 is an LED display, which is used to draw the bowler's attention to the lens for image pickup by the video camera 33 as described later. The video camera 33, the LED display 35 and the printer are shared between the right-and-left lanes. In addition, the video camera 33 and LED display 35 are used mainly for later-described embodiments.

FIG. 2B is a view showing the arrangement of the keyboard shown in FIG. 2A. Referring to FIG. 2B, function keys are given various functions corresponding to display contents which are displayed in lower part of the CRT 22*a* or 22*b* shown in FIG. 2A. Cursor keys are used to move the cursor up and down, left and right in the CRT screen. A ten-key pad and other keys are used for the correction of score and the like.

Figure 3:
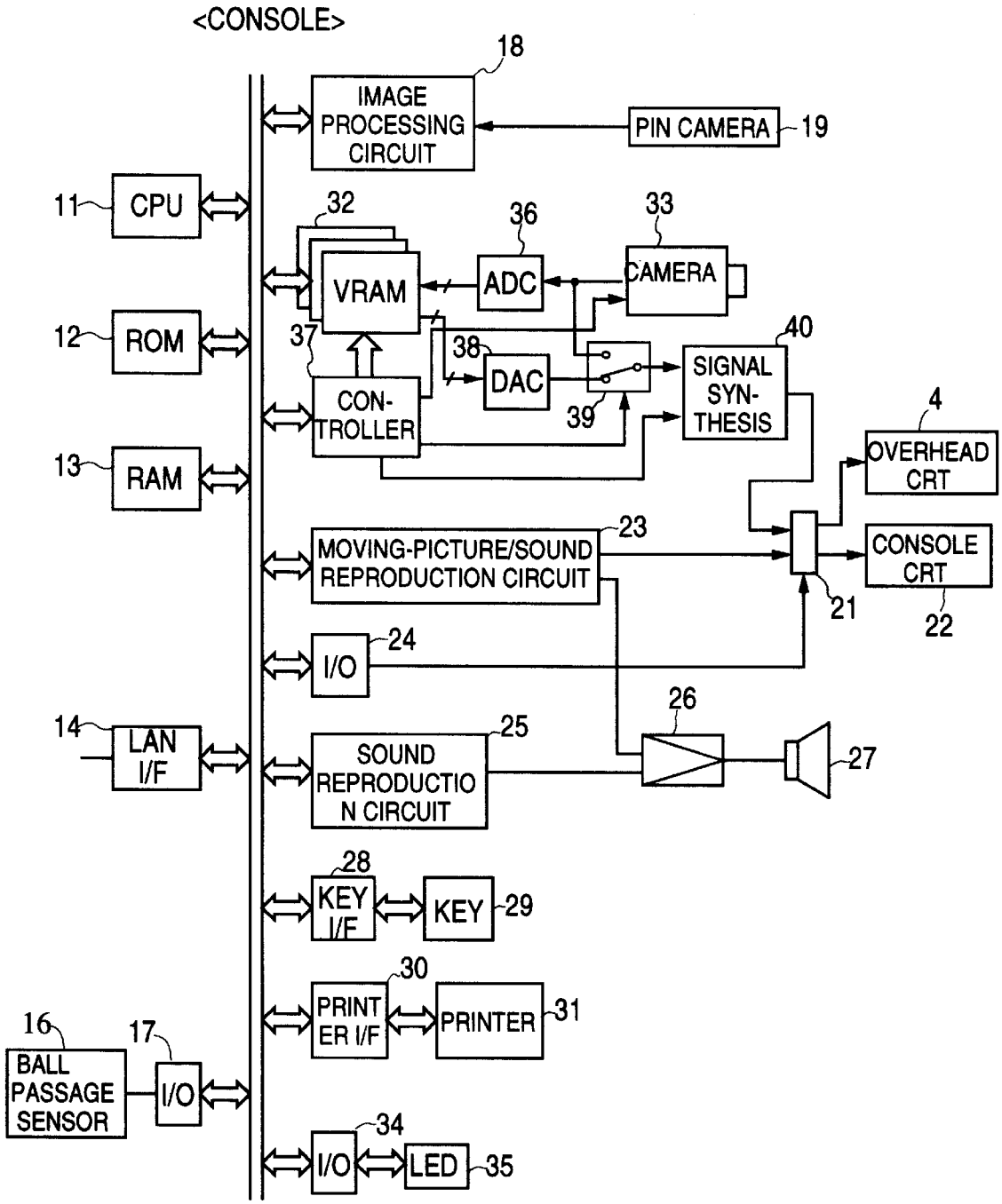
FIG. 3 is a block diagram showing the configuration of the console.

FIG. 3 is a block diagram showing the configuration of the console. A CPU 11, a ROM 12, a RAM 13, a LAN interface 14, a printer interface 30, a printer 31 and the camera 33 are shared between two lanes, while the other blocks are provided each two in correspondence to the two lanes, respectively, but shown only for one lane in the figure. The CPU 11 executes programs previously written in the ROM 12 and programs loaded to the RAM 13 to perform later-described scoring process and display control for an overhead CRT 4 and the console CRTs 22. The RAM 13 is used as a working area for those processes. The LAN interface 14 performs data transfer control in connection with the local area network. An image processing circuit 18 receives an image signal picked up by a pin camera 19, performs specified image processing on the image signal to generate binarized image data for facilitating the detection of standing pins and fallen pins. The CPU 11 reads the binarized image data to detect a standing/fallen state of the pins. A VRAM 32 is a memory for writing therein display data such as scores, game screens and reproduction images of still-picture files, and the like, and the CPU 11 writes into this VRAM 32 display data to be displayed on the CRT. A D/A converter 38 converts data outputted from the VRAM 32 into an analog signal. Numeral 39 denotes a video signal changeover switch (high-speed switching circuit), which feeds to a signal synthesis circuit 40 either an output signal of the D/A converter 38 or an output signal of the camera 33 according to a control signal. This signal synthesis circuit 40 synthesizes a synchronizing signal derived from a controller 37 with an output signal of the video signal changeover switch 39 to generate an image signal. An A/D converter 36 converts an image signal outputted from the camera 33 into a digital signal. The controller 37 performs the addressing and write control for the VRAM 32, and besides outputs a synchronizing signal to the camera 33. Also, the CPU 11 compresses image data written in the VRAM 32 into a still-picture file in the form of JPEG (Joint Photographic Experts Group standards) or GIF (Graphics Interchange Format), and stores it into a specified area of the RAM 13. A moving-picture/sound reproduction circuit 23 receives data of a moving-picture file (a file including not only moving-picture data but also sound data; hereinafter, referred to simply as "moving-picture file") in the form of MPEG (standardized by Moving Picture Experts Group), and reproduces image signals and sound signals. In addition, if the CPU 11 has sufficiently high data processing power, it may also be arranged that the CPU 11 performs the expansion of a moving-picture file and writes display data successively into the VRAM 32 to thereby fulfill the reproduction. Denoted by numeral 21 is a video signal switching circuit, which selects an image signal from either the moving-picture/sound reproduction circuit 23 or the signal synthesis circuit 40 according to an control signal outputted from an Image/One port 24, and outputs it to the overhead CRT 4 and/or the console CRT 22. A sound reproduction circuit 25 receives sound data such as an MIDI data file or a waveform data file to reproduce a musical sound signal. An amplifier 26 amplifies the signal and drives a loudspeaker 27. This sound reproduction circuit 25 is used to output musical sound or voice (speech) as a background simultaneously with the display of an animation or still pictures without using the moving-picture/sound reproduction circuit 23. A ball passage sensor 16 and the like are connected to an Image/One port 17, and the CPU 11 reads detection state of various sensors such as the ball passage sensor via the Image/One port 17. A key interface 28 reads contents of operation of the keyboards 29. The CPU 11 performs processing responsive to the contents of key operation via the key interface 28. The printer interface 30 drives the printer 31 based on a print signal fed from the CPU 11 to print a score sheet or a later-described commercial display screen. The LED 35, as shown in FIG. 2, is a display device for making bowlers' eyes focused on the camera, where the CPU 11 controls the blinking of the display device via an Image/One port 34.

Figure 4:
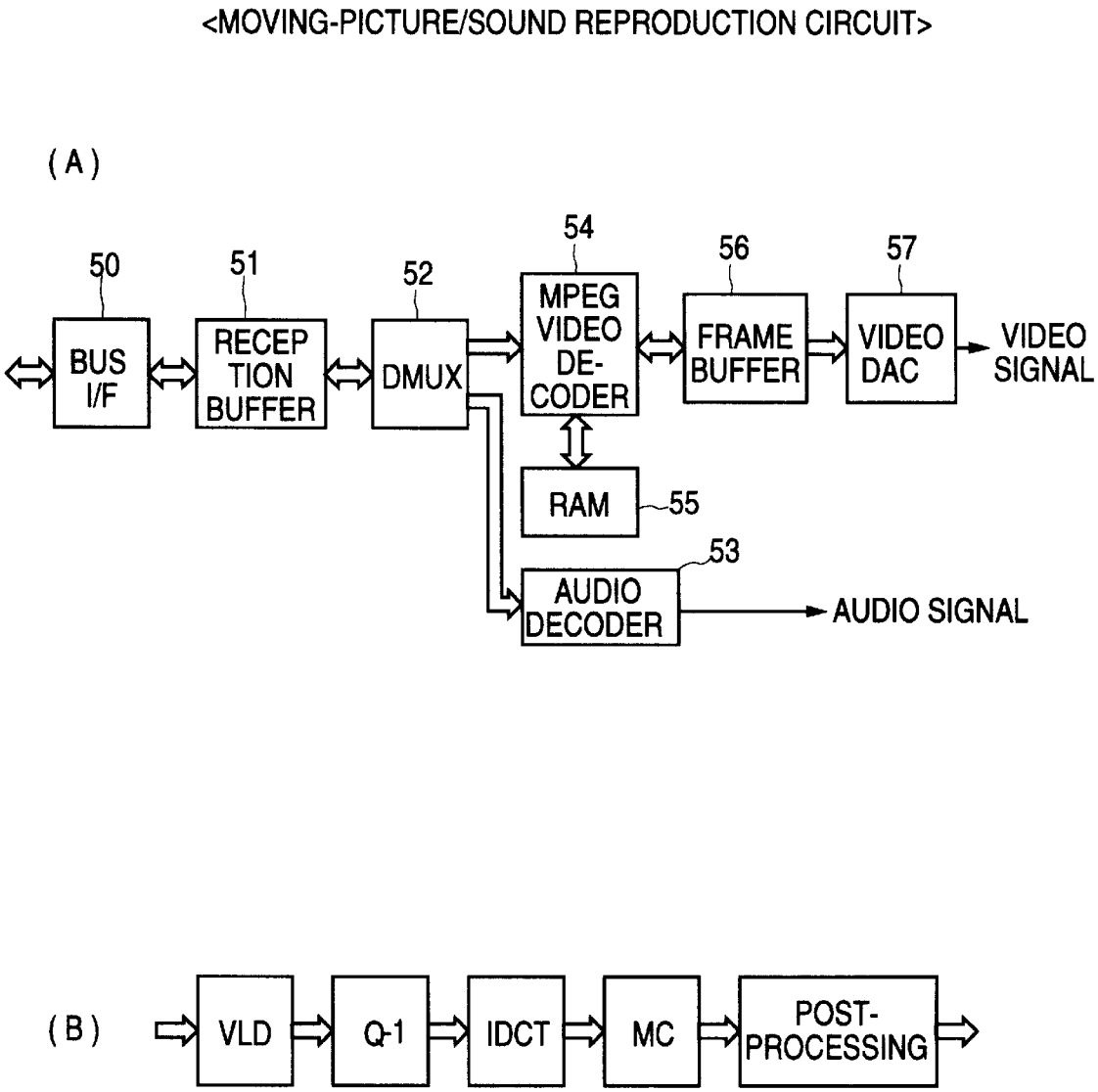
FIG. 4 is a block diagram showing the configuration of the moving-picture/sound reproduction circuit.

FIG. 4 is a block diagram showing the configuration of the moving-picture/sound reproduction circuit 23 shown in FIG. 3. In FIG. 4A, a bus interface 50 interfaces the moving-picture/sound reproduction circuit with the system bus of the console. A reception buffer 51 buffers input data. A demultiplexer 52 separates an MPEG system stream fed from the reception buffer 51 into an MPEG video stream and an MPEG audio stream, feeding them to an MPEG video decoder 54 and an audio decoder 53, respectively. The MPEG video decoder 54 decodes image data with a RAM 55 used as a working area. A frame buffer 56 temporarily stores image data corresponding to one screen, and a video D/A converter 57 generates an analog image signal from the image data. The audio decoder 53 decodes the fed MPEG audio stream and outputs a sound signal. FIG. 4B is a functional block diagram of the MPEG video decoder 54 in FIG. 4A. A VLD (Variable Length Decoding) section decodes an input variable length code to determine a quantization coefficient or motion vector. A From-1 (inverse quantization) section determines a DCT (Discrete Cosine Transform) coefficient by multiplying the quantization coefficient by the value of a quantization step From. An IDCT (Inverse Discrete Cosine Transform) section performs inverse DCT process on the DCT coefficient, and calculates pixel values (brightness, color difference) for every 8×8 pixel blocks. In addition, actual pixel values themselves are determined for Image pictures and difference values between corresponding pixel values are determined for Step picture and Bowling picture. An MC (Motion Compensation) section adds up blocks compensated by the difference values between the pixel values of the Step picture and the Bowling picture determined by IDCT as well as the motion vector, thereby decoding the Step picture and the Bowling picture. A post-processing section performs an interpolation process between lines.

Figure 5:
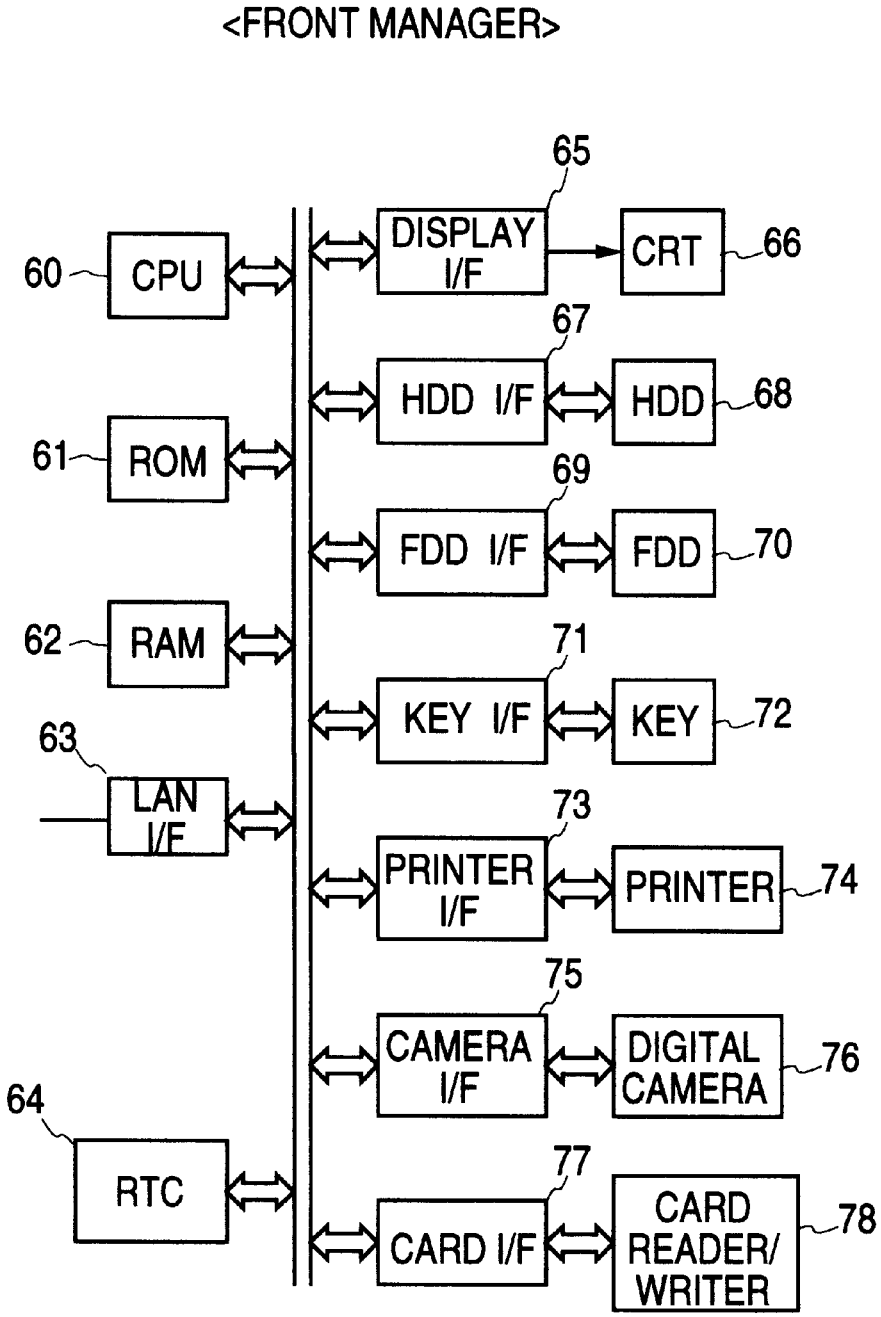
FIG. 5 is a block diagram showing the configuration of the front manager.

FIG. 5 is a block diagram showing the configuration of the front manager. A CPU 60 executes programs previously written in a ROM 61, and executes various processes as will be described. A RAM 62 is used as a working area in those processes. A LAN interface 63 performs data transfer control in conjunction with the local area network. Denoted by numeral 64 is a clock circuit, which clocks the current date and time. A display interface 65 comprises a display memory and a display signal generation circuit for displaying, in a list form, the state of use of each lane and the progress of the game that has been made so far or the like, the circuit serving to display the contents of the display memory on a CRT 66. A hard disk drive 68 and a floppy disk drive 70 are used to store programs and data to be downloaded to each console, and the CPU 60 performs data read/write operations via a hard disk drive interface 67 and a floppy disk drive interface 69. A keyboard 72 is used for the entry of incoming bowlers' names in their reception, the designation of an empty lane or the input of a message or the like to be displayed on the console-side CRT, where the CPU 60 reads the contents of key operation via a key interface 71. A printer 74 is used for the printing of score sheets and the like on the front manager side, where the CPU 60 performs print control via a printer interface 73. A digital camera 76 is provided for picking up images of bowlers' faces, where bowlers' image information is obtained by picking up images of the bowlers' faces in their reception, as required. This digital camera 76 contains a flash memory to temporarily store therein the data of picked-up images in a compressed JPEG form or the like. A camera interface 75 is a serial interface, and the CPU 60 reads image data via the camera interface 75 and stores them in the hard disk drive 68 as a bowlers' image file. A card reader/writer 78 is to perform the read and write of a member's card which comprises a magnetic card or IC card. This member's card has information as to the name, date of birth, handicap, and the like written therein. In the case of an IC card, it is possible that the bowler's image information corresponding to the above bowlers' image file is written in the IC card. Reception process for a member can be completed only by reading this member's card.

Figure 6:
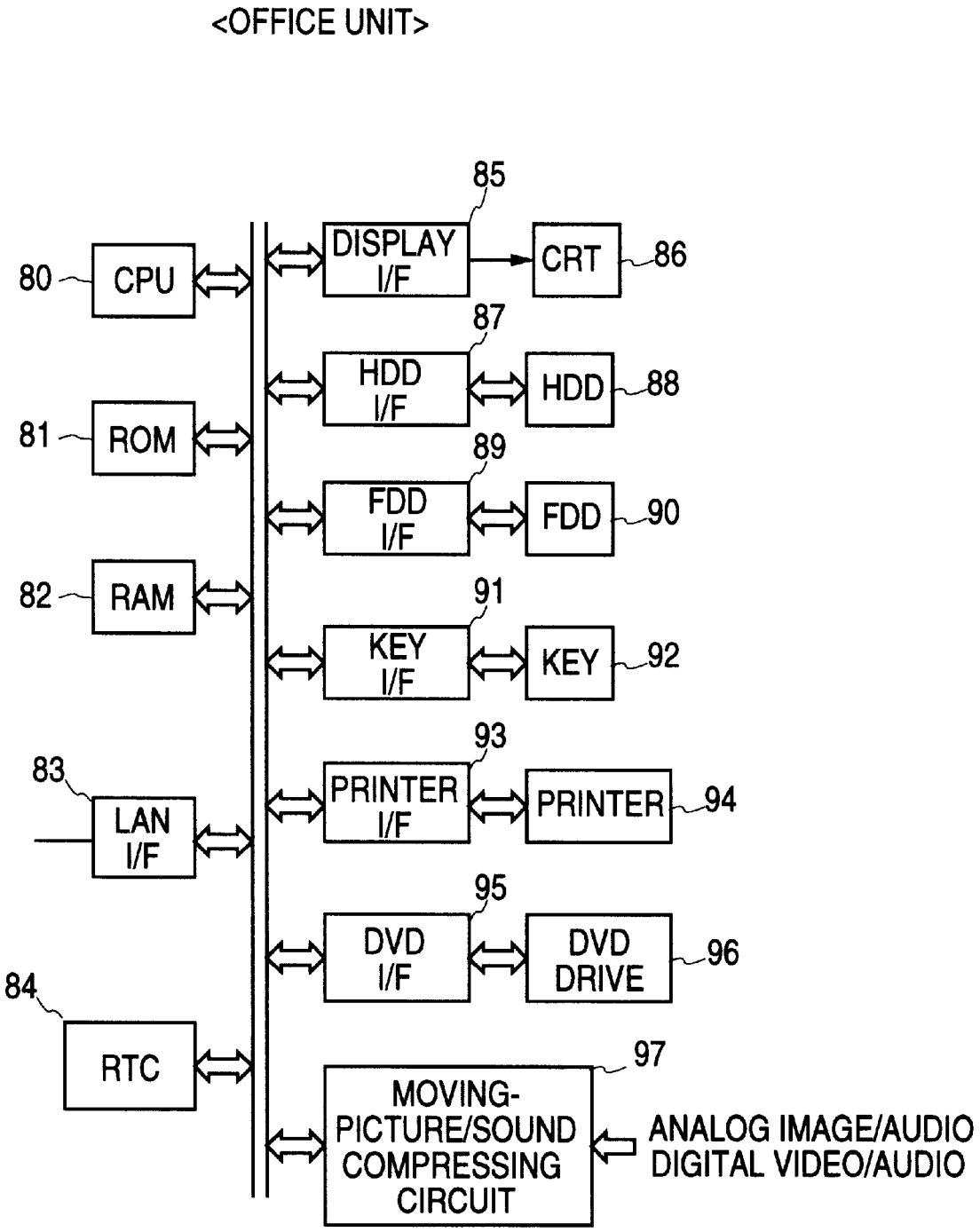
FIG. 6 is a block diagram showing the configuration of the office unit.

FIG. 6 is a block diagram showing the configuration of the office unit. Its difference from the front manager shown in FIG. 5 is that the office unit of FIG. 6 comprises a DVD (Digital Video Disk) drive 96, an interface 95 therefor and a moving-picture/sound compressing circuit 97. The DVD drive 96 performs the read and write of a moving-picture file written in the DVD-RAM. For example, it reads a previously recorded commercial moving-picture file from the disk. The CPU accumulates the moving-picture file in the hard disk (disk array). Further, the moving-picture/sound compressing circuit 97 encodes an analog image/sound signal or digital image/sound data into MPEG2 form, and the CPU stores them in the hard disk in the form of data file. A floppy disk drive 90 is used for the read of still-image files, MIDI data files, waveform data files and the like prepared outside, and a CPU 80 reads the data via a floppy disk drive interface 89 and stores them in the hard disk. It is noted that a process concerning the later-described schedule is performed based on the clocking contents of a clock circuit 84.

Figure 7:
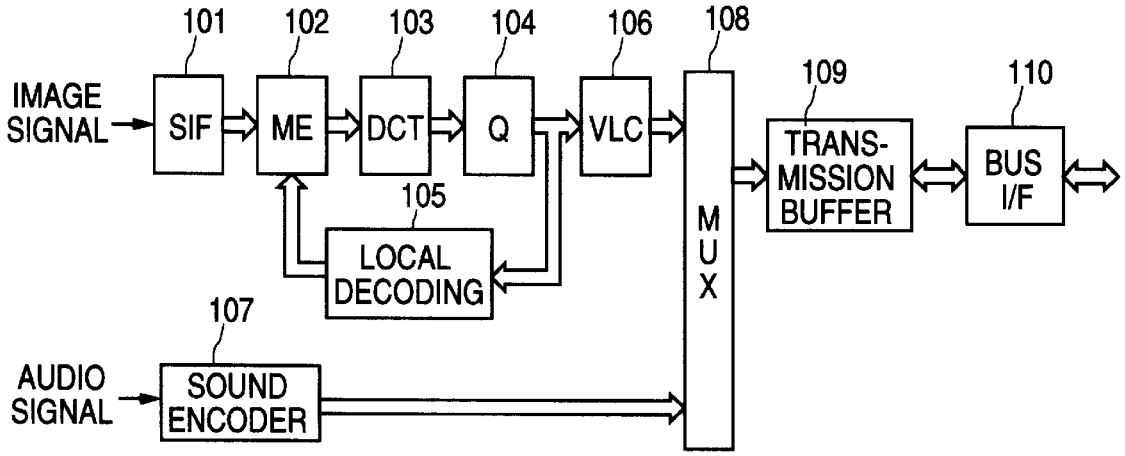
FIG. 7 is a block diagram showing the configuration of the moving-picture/sound compression circuit.

FIG. 7 is a block diagram showing the configuration of the moving-picture/sound compressing circuit shown in FIG. 6. In this block, an SIF (Source Input Format) conversion section 101 performs the format conversion of a source input, i.e., performs the processes of field decimation, band limitations of brightness and color-difference signals or the like on raw image data of an input video signal. An MEANS (Motion Estimation) section 102 calculates the motion vector of an input image in the unit of 16×16 macro blocks. A DCT (Discrete Cosine Transform) section 103 subjects the difference between the motion-compensated image and the input image to a two-dimensional discrete cosine transform in a block size of 8×8 pixels. A From (Quantization) section 104 quantizes the DCT transform coefficient (i.e., executes an arithmetic operation of dividing the coefficient by the value of the quantization step From and omitting the remainder) by using a matrix table. A VLC (Variable Length Coding) section 106 converts quantized values read under progress of a zigzag scan from lower frequency terms to higher frequency terms into a variable length code by combination of run length code and Huffman code to generate an MPEG video stream. A local decoding section 105 performs From-1 and IDCT processes by the procedure shown in FIG. 4B, and feeds the processing result to the MEANS section as a comparative image. Meanwhile, a sound encoder 107 encodes an input audio signal to generate an MPEG audio stream. Then, a multiplexer MUX 108 multiplexes the MPEG video stream and the MPEG audio stream on the other data such as data for synchronization of image and sound, thereby generating an MPEG system stream. A transmission buffer 109 buffers output data, and a bus interface 110 performs interface with the system bus of the office unit shown in FIG. 6.

FIG. 8 is a view showing an example of the automatic reproduction setting table, and FIG. 9 is a view showing an example of the schedule table. As will be described later, the front manager transfers a moving-picture file, a still-picture file and an audio file to specified consoles by looking up in these automatic reproduction setting table and schedule table. Each of the consoles receives these files and displays a moving picture or a still picture on the overhead CRT or the console CRT with sound output.

Referring to FIG. 8, the item of schedule name shows that a schedule designated by its corresponding name is executed, and the item of date shows a date or weekday on which the schedule shown by the item of schedule name is executed. In the example shown in the figure, a schedule named SCH1 is executed on Apr. 6, 1997, a schedule named SCH3 is executed on Apr. 7, 1997, and a schedule named SCH2 is executed on Apr. 12, 1997. After that, likewise, when the day of a set date has come, its corresponding schedule is executed. As to days which are not set by any date, a schedule shown by SCHwk is executed on weekdays (Monday to Friday). Likewise, a schedule shown by SCHsa is executed on Saturdays, a schedule shown by SCHsu is executed on Sundays, and schedules shown by SCHfe1, SCHfe2, . . . are executed on previously registered national holidays or festival days.

The schedule table, as shown in FIG. 9, contains time-delimiting data as well as commands, and if necessary, parameters set for each of the schedule names. In this table, commands such as SUB1 and SUB2 are designations for subroutines, where subroutines shown by the names such as SUB1 and SUB2 are executed. A parameter "5" shows that the command is repeated five times, a parameter "1H" shows that the command is repeated for one hour, and a parameter "40M" shows that the command is repeated for 40 minutes. Also, in the subroutines, an MPEG command is a command for treating the parameter as the file name of an MPEG file (aforementioned moving-picture file) and reproducing the file. In the example shown in the figure, in the schedule shown by SCH1, the MPEG file whose file name is 101 is reproduced at 9:00 a.m., and subsequently reproduces the MPEG file whose file name is 102 and subsequently reproduces the MPEG file whose file name is 103. Further, for example, at time 9:20 a.m., the processing of SUB2, i.e., the reproduction of the MPEG files of the file names 201 and 202 is reproduced five times. In the schedule shown by SCH2, at time 9:00 a.m., the processing of SUB1 is repeated for one hour. In the schedule shown by SCH3, at time 9:20 a.m., the processing of SUB3 is repeated for 40 minutes. A JPEG command is a command for treating the parameter as the file name of a JPEG file (aforementioned still-picture file) and reproducing the file. Further, a GOTO LOOP command is a command for returning to a label shown by LOOP. Therefore, in this example, the JPEG files shown by the file names 301, 302 and 303 are repetitively reproduced. As a result, still pictures are repetitively displayed in steps of specified time.

The automatic reproduction setting table and the schedule table correspond to "image reproduction control data" according to the present invention.

Figure 10:
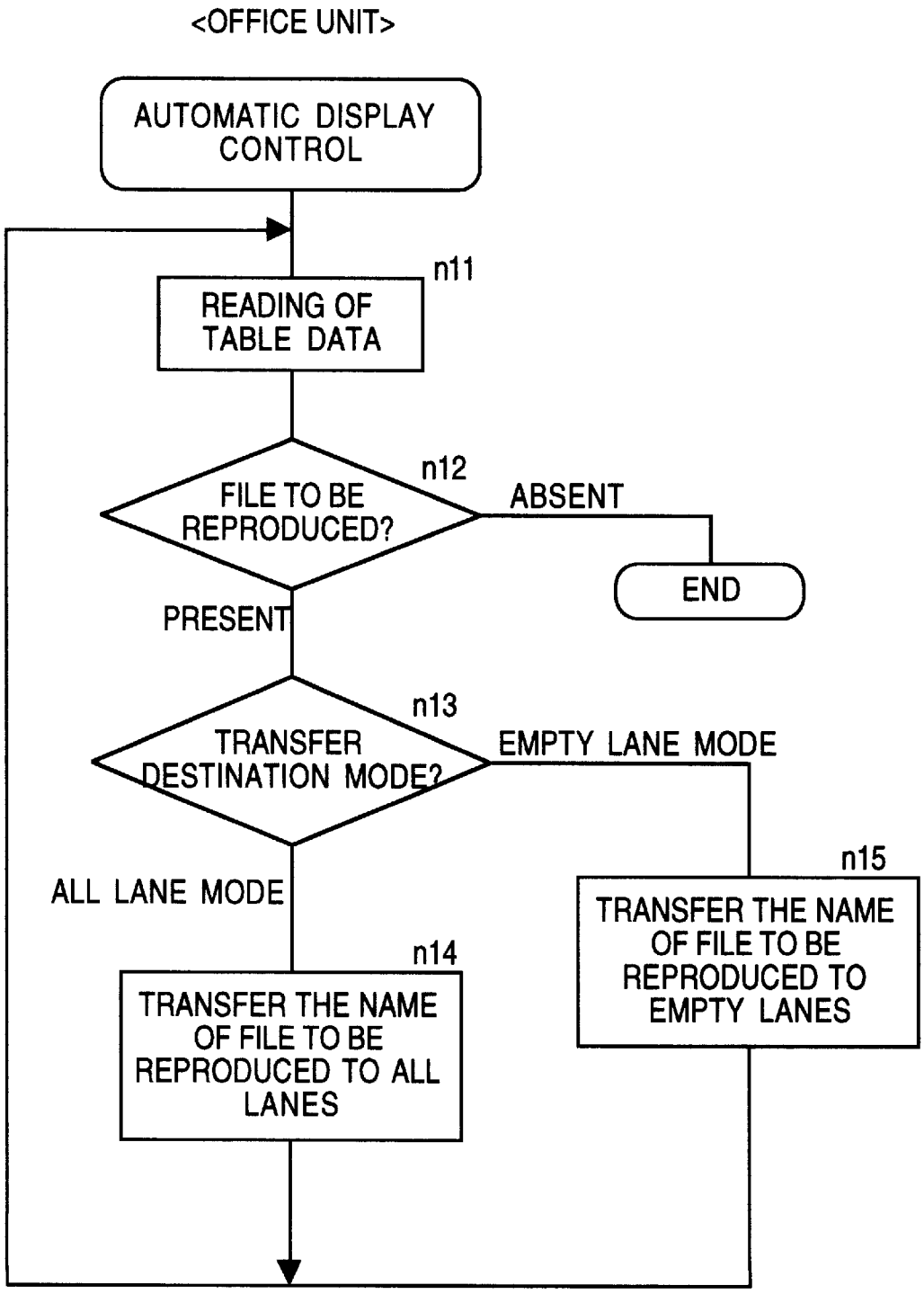
FIG. 10 is a flow chart showing the contents of automatic display control process in the office unit.

FIG. 10 is a flow chart showing a processing procedure in the office unit for automatically displaying a specified image onto the console-side CRT. First, table data shown in FIGS. 8 and 9 are read, and through a comparison of the current date and time against the contents of the tables shown in FIGS. 8 and 9, it is decided whether or not a file to be reproduced is present (n11→n12). If the file to be reproduced is present, then it is transferred to the console, where the name of the file to be reproduced is transferred via the local area network to the consoles of all the lanes or the console of empty lanes, whichever it is, depending on a predetermined transfer destination mode (a mode showing whether the file is displayed on the overhead CRTs of all the lanes or only on the overhead CRTs of empty lanes) (n13→n14,n15). This file name of the file to be reproduced corresponds to "control data" according to the present invention. It is noted that the transfer destination mode has previously been set by key operation in the office unit.

Figure 11:
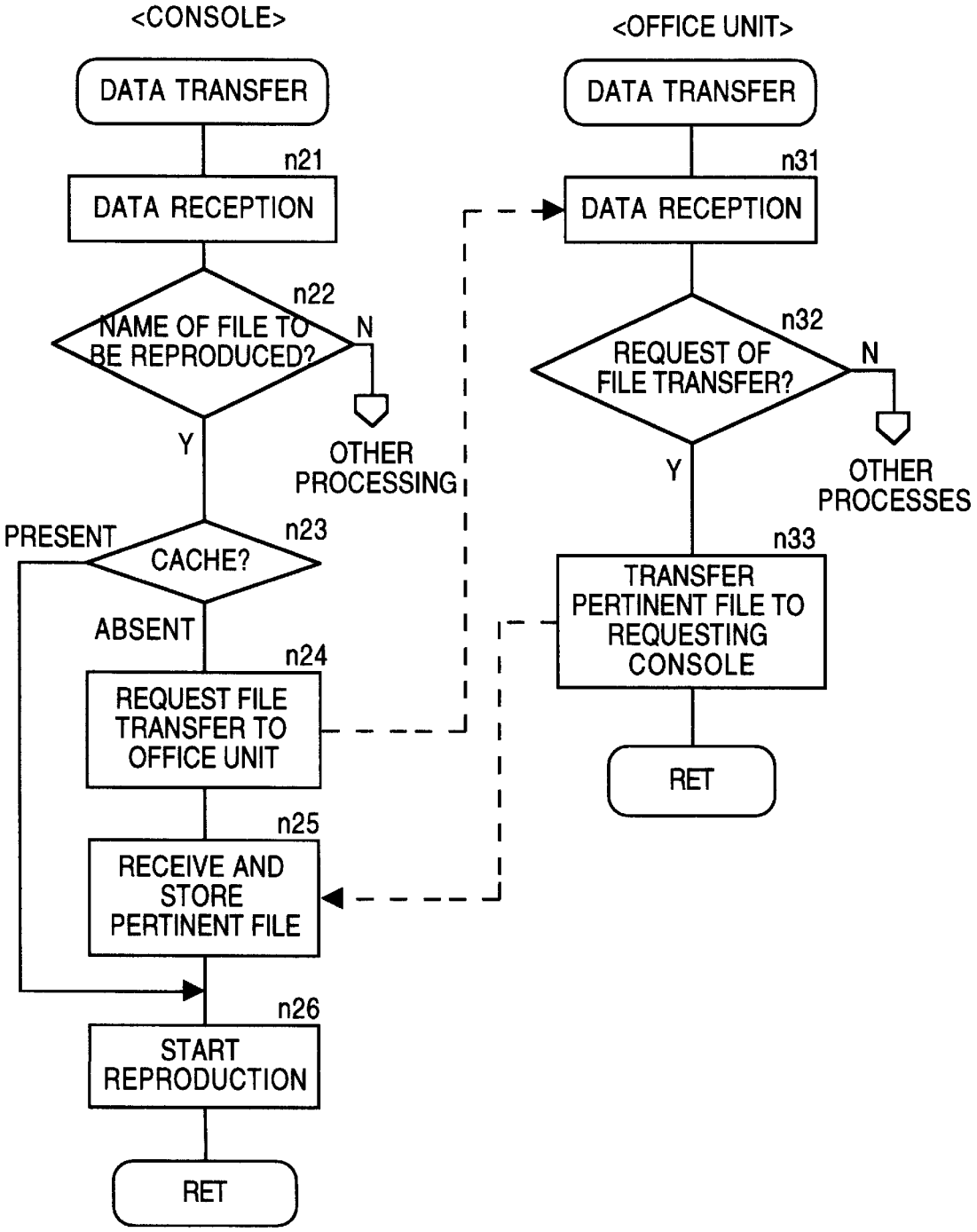
FIG. 11 is a flow chart showing the contents of data transfer process in the office unit.

FIG. 11 is a flow chart showing the processing contents of data transfer control in the console and the office unit. First, the console receives data from the office unit (n21), where if it is the name of the file to be reproduced, it is decided whether or not the file has already been accumulated in a specified area (hereinafter, referred to as "cash") on the RAM on the console side (n22→n23). If it has not yet been accumulated, then the console transmits a transfer request to the office unit (n24). The office unit, upon receiving this request, transfers the contents of the file to the requesting console responsively (n31→n32 n33). The console receives and stores this data, and starts the reproduction (n25→n26). If the file has already been accumulated in the cache, the console successively reads its file data and starts the reproduction (n23→n26).

In this way, image or audio data prepared or entered and filed at the office unit is transferred from the office unit to the console, by which specified moving pictures or still pictures and sounds are outputted on the console-side CRTs.

Next, a bowling alley management system according to a second embodiment is described with reference to FIGS. 12 to 15.

FIG. 12 is a table showing the relationship between commercial numbers and commercial contents for the display of commercials. In the figure, the item "reproduced file" shows the name of a file to be reproduced, and the item "parameter" shows a parameter to be used for reproducing the file. The reproduction of commercials is carried out by sequentially reproducing commercials with reference to this table by commercial number. For example, if a commercial number 1 is designated, then a JPEG file shown by the file name JPEG×1 and an MIDI file shown by the MIDI file name MIDI×1 are reproduced. A parameter "5S" shows that this reproduction is continued for 5 seconds. Subsequently, a JPEG file shown by the file name JPEG×2 and an MIDI file shown by the file name MIDI×2 are reproduced for 5 seconds. From this on, this goes similarly. Also, for example, if a commercial number 2 is designated, then an MPEG file shown by the file name MPEGa is reproduced. Subsequently, an MPEG file shown by the file name MPEGb is reproduced, and further an MPEG file shown by the file name MPEGc is reproduced.

Figure 13:
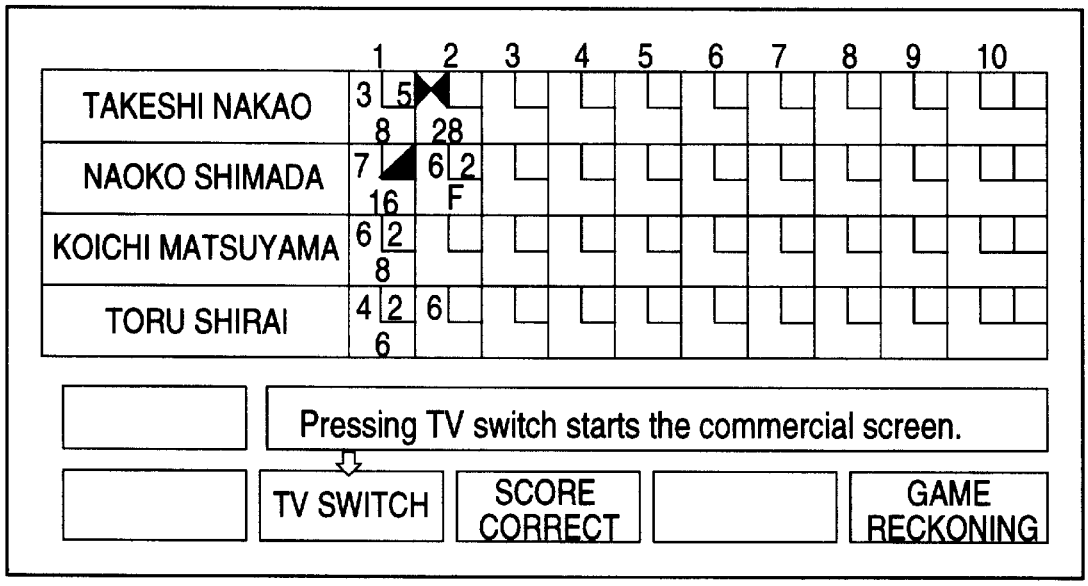
FIG. 13 is a view showing a display example in a console according to a second embodiment.
Figure 13:
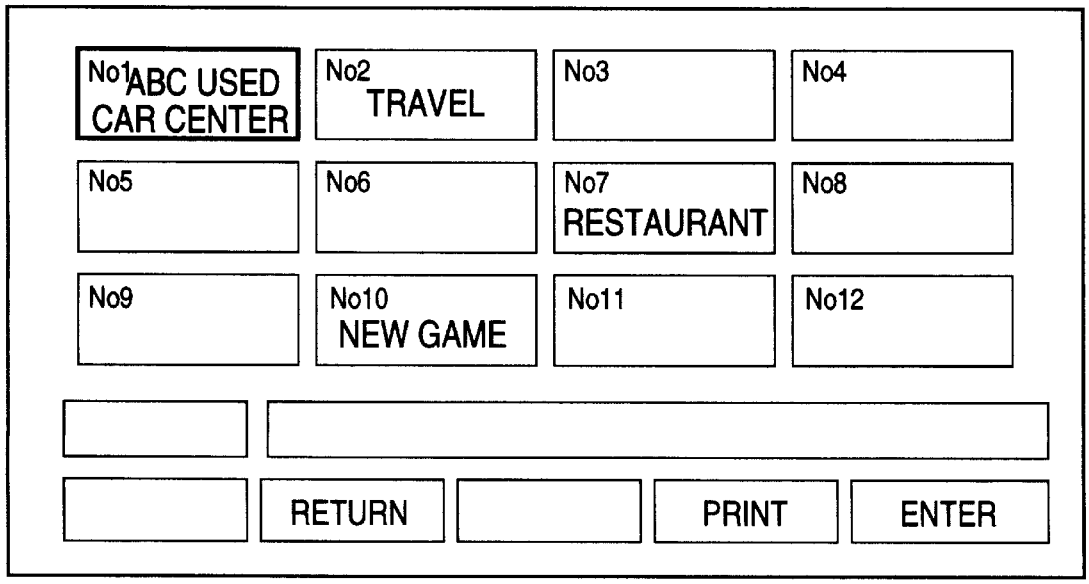

FIG. 13 is a view showing an example of the display contents of the CRT (console CRT) in the console. As shown in FIG. 13A, a message that pressing the TV switch (a function key displayed as "TV switch") starts the commercial screen is presented. Then, if the TV switch is operated here, a guidance display for commercials is given as shown in FIG. 13B. Each of these pictures is the front page or head frame of a commercial displayed by its corresponding number. For example, moving the cursor to No. 1 and operating the enter key (a function key indicated as "ENTER" causes the pictures and sounds of the No. 1 commercial (ABC Used Car Center's commercial in this example) to be reproduced.

Figure 14:
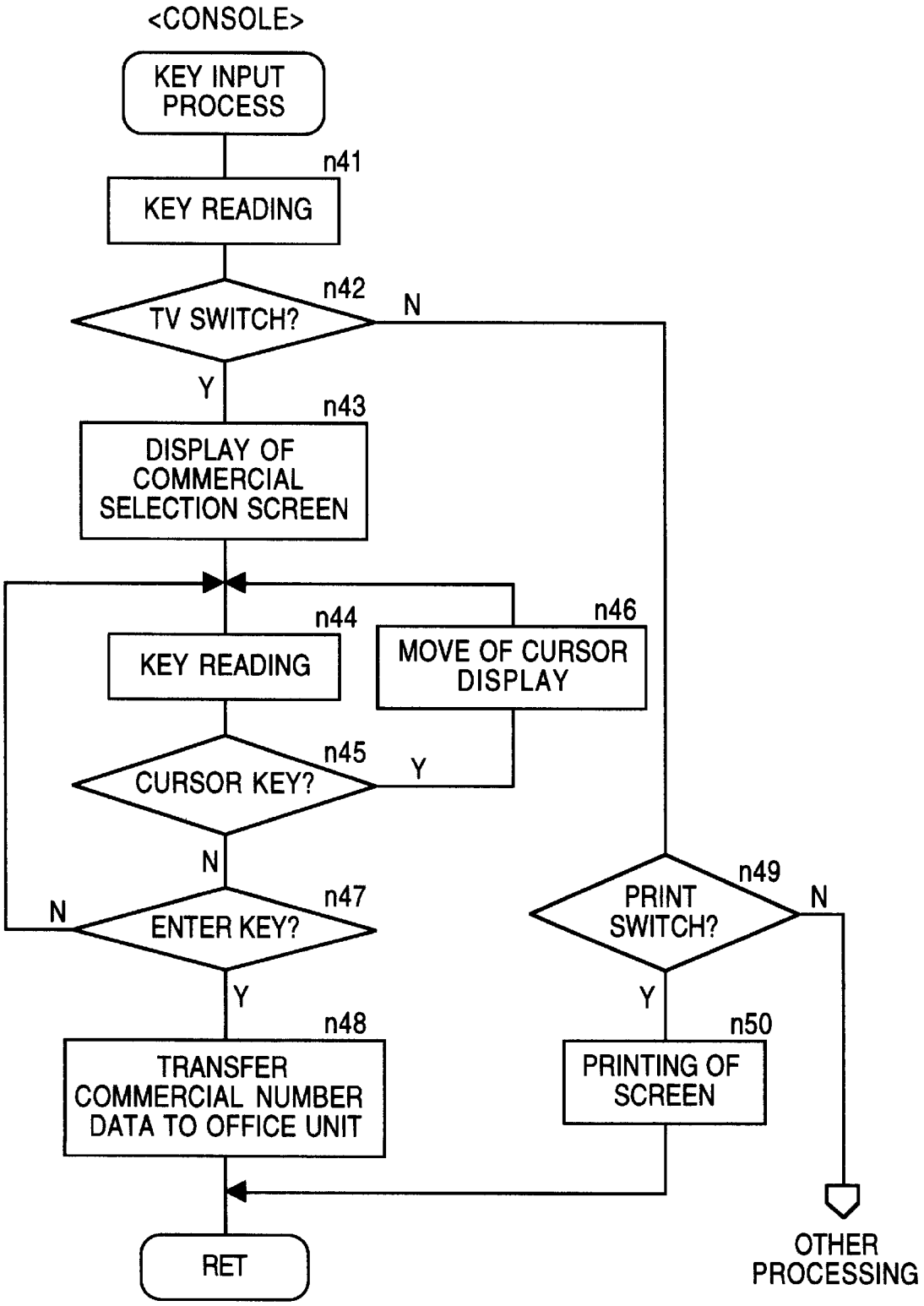
FIG. 14 is a flow chart showing the contents of key input process in the console.

FIG. 14 is a flow chart showing the contents of key input process in the console. First, the contents of the key operation is read, and if it is detected that the TV switch has been operated, a commercial selection screen is displayed as shown in FIG. 13B (n41→n42→n43). If the cursor key is operated in this state, the cursor display is moved according to the direction of the operation (n44→n45→n46). In this case, the cursor display is implemented by displaying the outer frame of the picture under selection in bold line. Then, upon operation of the enter key, the commercial number data is transferred to the office unit (n47→n48).

Figure 15:
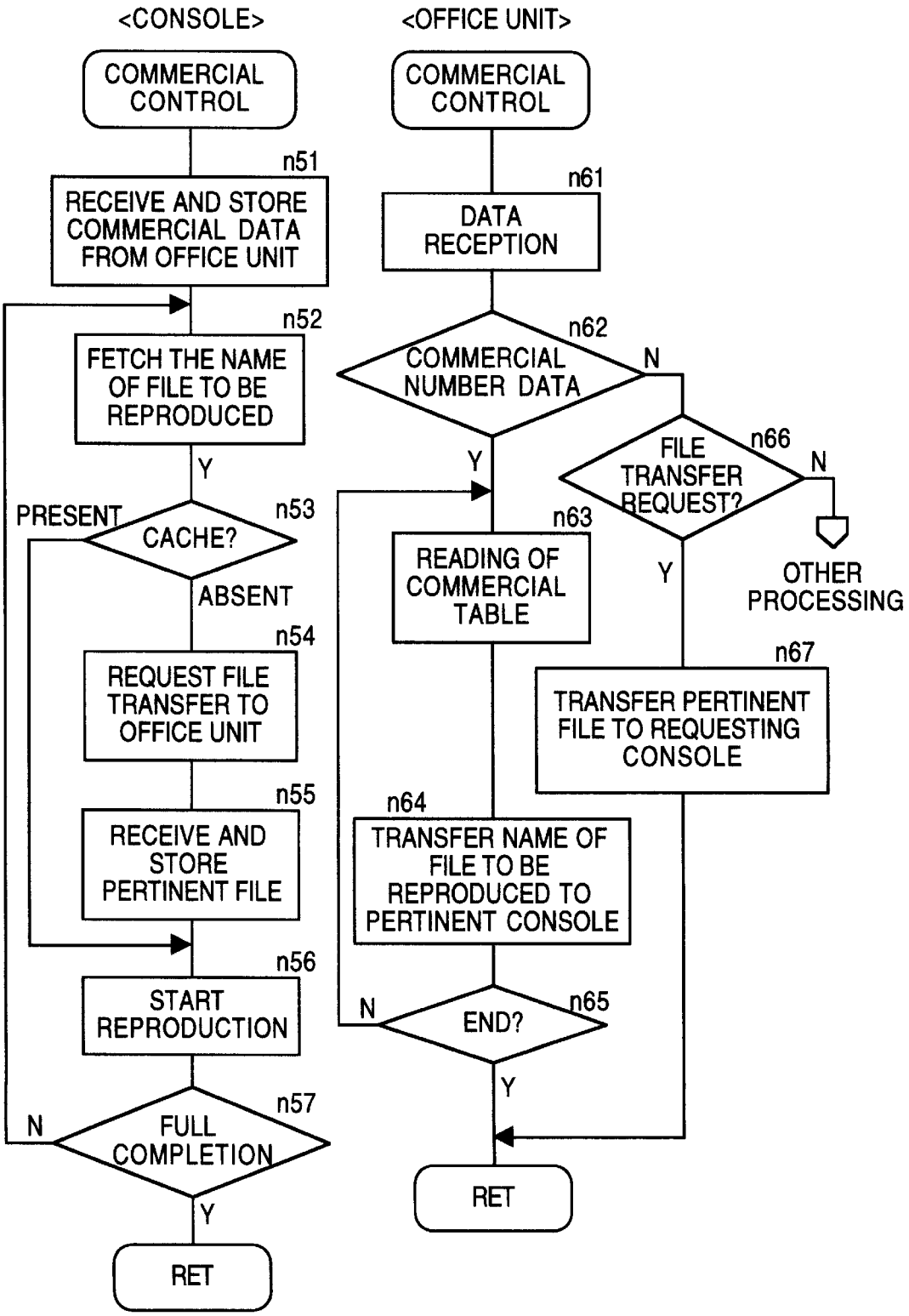
FIG. 15 is a flow chart showing the contents of commercial control in the console and the office unit.

FIG. 15 is a flow chart showing the procedure for commercial control in the console and the office unit. As shown in FIG. 15, the office unit, upon receiving this commercial number data, successively transfers to the pertinent console the file names of files to be reproduced by looking up in the commercial table shown in FIG. 12 on the basis of the commercial numbers (n61→n62→n63→n64→n65→n63 . . . ). The console receives and stores the file names of these files to be reproduced, and besides sequentially fetches out the file names of the files to be reproduced (n51→n52). If data of the file is not present in the cache, the console requests the office unit to transfer the file (n53→n54). Responsive to this, the office unit transfers the relevant file data to the console (n66→n67). The console, upon receiving the contents of the file from the office unit, accumulates the file data in the cache, starting its reproduction (n55→n56). If the file data has already been accumulated, then the console starts to sequentially read the file data from the cache and start the reproduction without issuing a file transfer request to the office unit (n53→n56). This process is executed sequentially for all the files to be reproduced (n57→n52→. . . ). In addition, in the reproduction of the commercials, if the print switch (a function key indicated as "PRINT") of FIG. 13B is operated during the reproduction of still pictures (while the contents of the VRAM 32 shown in FIG. 3 is being displayed), a print (hard copy) of the screen is outputted (n49→n50 in FIG. 14). More concretely, referring to FIG. 3, the CPU 11 sequentially reads the contents of the VRAM 32, and besides writes them into the buffer within the printer interface 30, thus effecting a print of one screen.

In this way, a channel selection on the console side allows bowlers to watch the pertinent commercials.

Next, the configuration of a console for bowling according to a third embodiment is described with reference to FIGS. 16 to 20.

Figure 16:
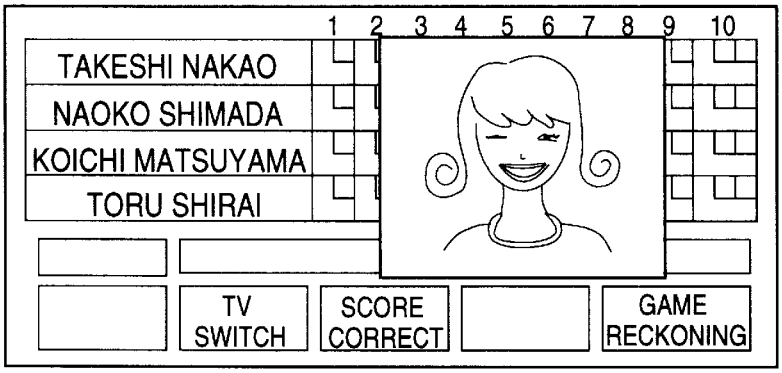
FIG. 16 is a view showing display examples of a console for bowling according to a third embodiment.
Figure 16:
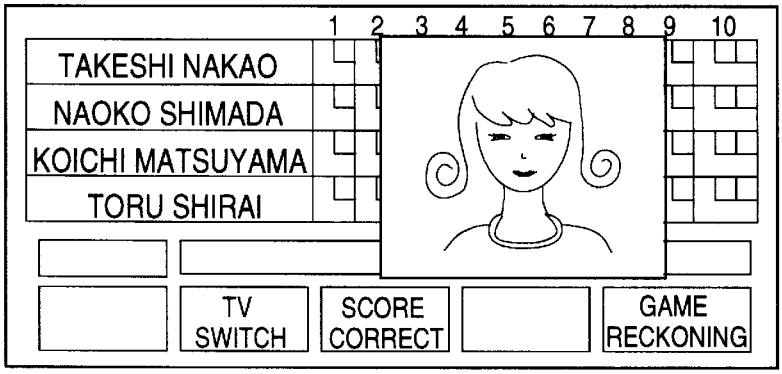
Figure 16:
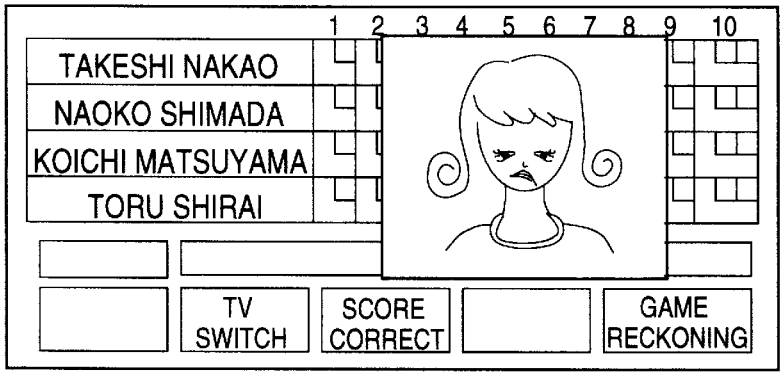
Figure 16:
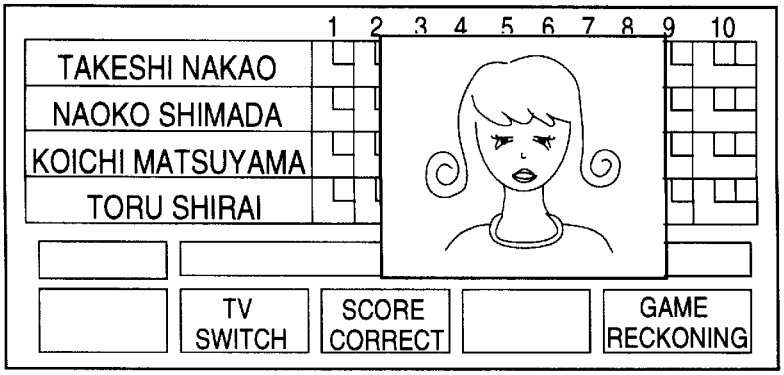

FIG. 16 is a view showing display examples in the console. FIG. 16A is an example of display that, upon occurrence of a strike, an image of the bowler's face (upper half of the body) is superimposed on a score display. FIG. 16B is an example of display that an image of the bowler's face (upper half) is superimposed on a score display. Similarly, FIGS. 16C and 16D show display examples for a one-pin left state and occurrence of a gutter, respectively, where their respective images of the bowler' face (upper half) are superimposed on the score display. These bowler's images are deformations of bowler's image information serving as one base through morphing process (in particular, warping). In this way, by presenting various displays using an image including the face of a bowler that has made the bowl depending on the result of the bowl, services to bowlers can be improved without boring the bowlers.

FIG. 17 is a view showing an example of the member master file. This is one in which information about individual members has previously been registered, where the member information comprises the name, date of birth, handicap, member's (bowler's) image file or the like. In this case, a plurality of image files having various looks of each member are previously registered as the image file.

Figure 18:
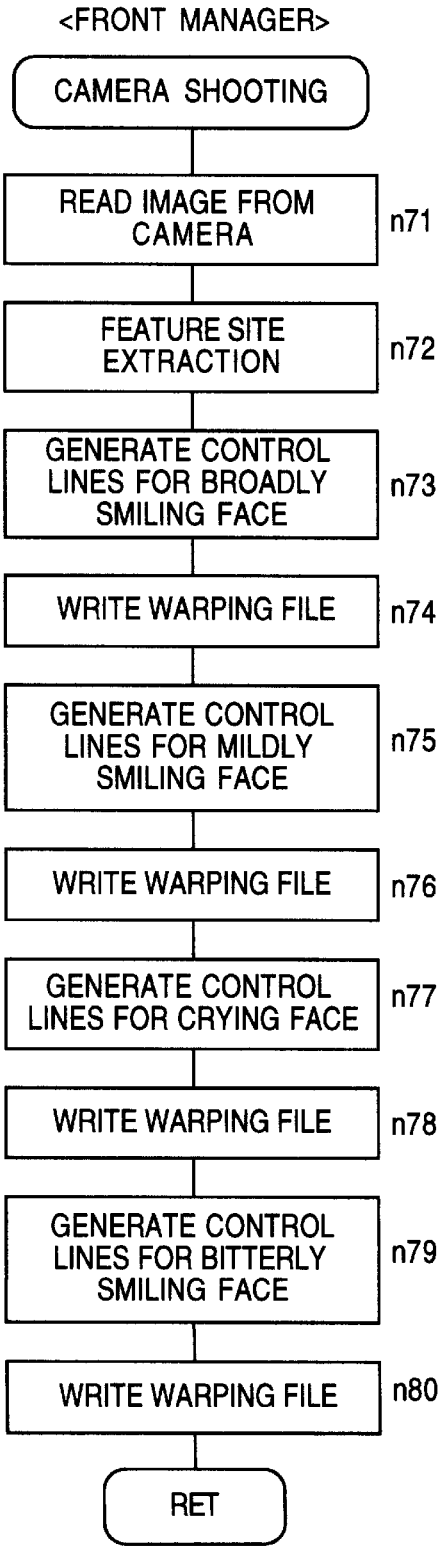
FIG. 18 is a flow chart showing the contents of image capturing process by the camera in the front manager.

FIG. 18 is a flow chart showing the processing contents in the front manager during an image capture by the camera. First, image data from the camera is read and temporarily stored (n71). Subsequently, from the image data, upper and lower lines of the right and left eyes and upper and lower lines of the lips are extracted as feature sites, respectively by image processing (n72). This extraction is carried out automatically or manually. After that, control lines for warping are created. These control lines are approximate straight lines of the upper and lower lines of the right and left eyes and approximate straight lines of the upper and lower lines of the lips as shown in FIG. 19A. More accurately, these are totally 12 straight lines obtained by dividing these approximate straight lines at their middle points, respectively. Subsequently, these control lines are changed in length, gradient and position, respectively, by which four bowler's images of different looks are generated in succession by the method of warping (n73–n80). This warping technique is disclosed in, for example, "An Introduction to Morphing" (Scott Anderson, translated by Hiraku Sakai, published by Kaibundo Shuppan on Dec. 15, 1994).

Figure 19:
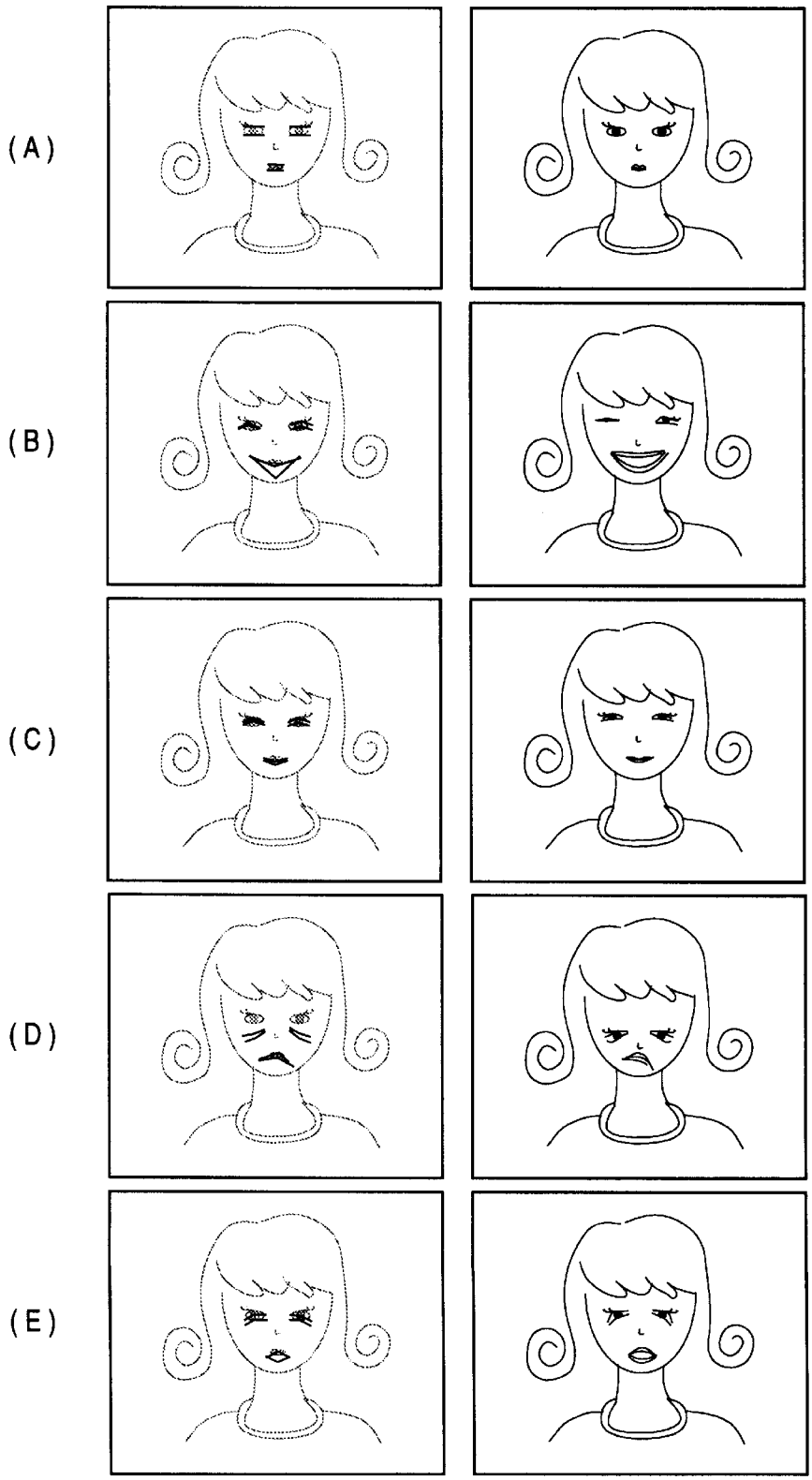
FIG. 19 is a view showing an example of morphing with a bowler's image.

A left-side half of FIG. 19 shows the configurations of the original image and control lines, while its right-side half shows warping results by those control lines. FIG. 19A shows the initial control lines and original image. Warping these control lines by deformation as shown in FIG. 19B results in a deformed broadly smiling face, warping the control lines by deformation as shown in FIG. 19C results in a mildly smiling face, warping the control lines by deformation as shown in FIG. 19D results in a crying face, and warping the control lines by deformation as shown in FIG. 19E results in a bitterly smiling face. The examples shown in FIG. 16 are based on these warping results.

Besides the warping technique, the image morphing process may be implemented by dissolving method. In this method, an original image and a target image are given, and then an image intermediate between them is created. This dissolving technique is also disclosed in the aforementioned reference, "An Introduction to Morphing (Scott Anderson, translated by Hiraku Sakai, published by Kaibundo Shuppan on Dec. 15, 1994)". For example, on condition that the original image is an image of a bowler and the target image is a face of some famous character, an intermediate image between them can be generated. In this case, it is also possible that some varieties of images are generated depending on whether or not the resulting image is more sided to the original image or to the target image, so that the images can be used in various situations as described above.

Otherwise, it is also possible that a plurality of different several background-forming or frame-forming images are combined with a bowler's image to generate a plurality of so-called collaged images, so that they can selectively be displayed in the above various situations.

Figure 20:
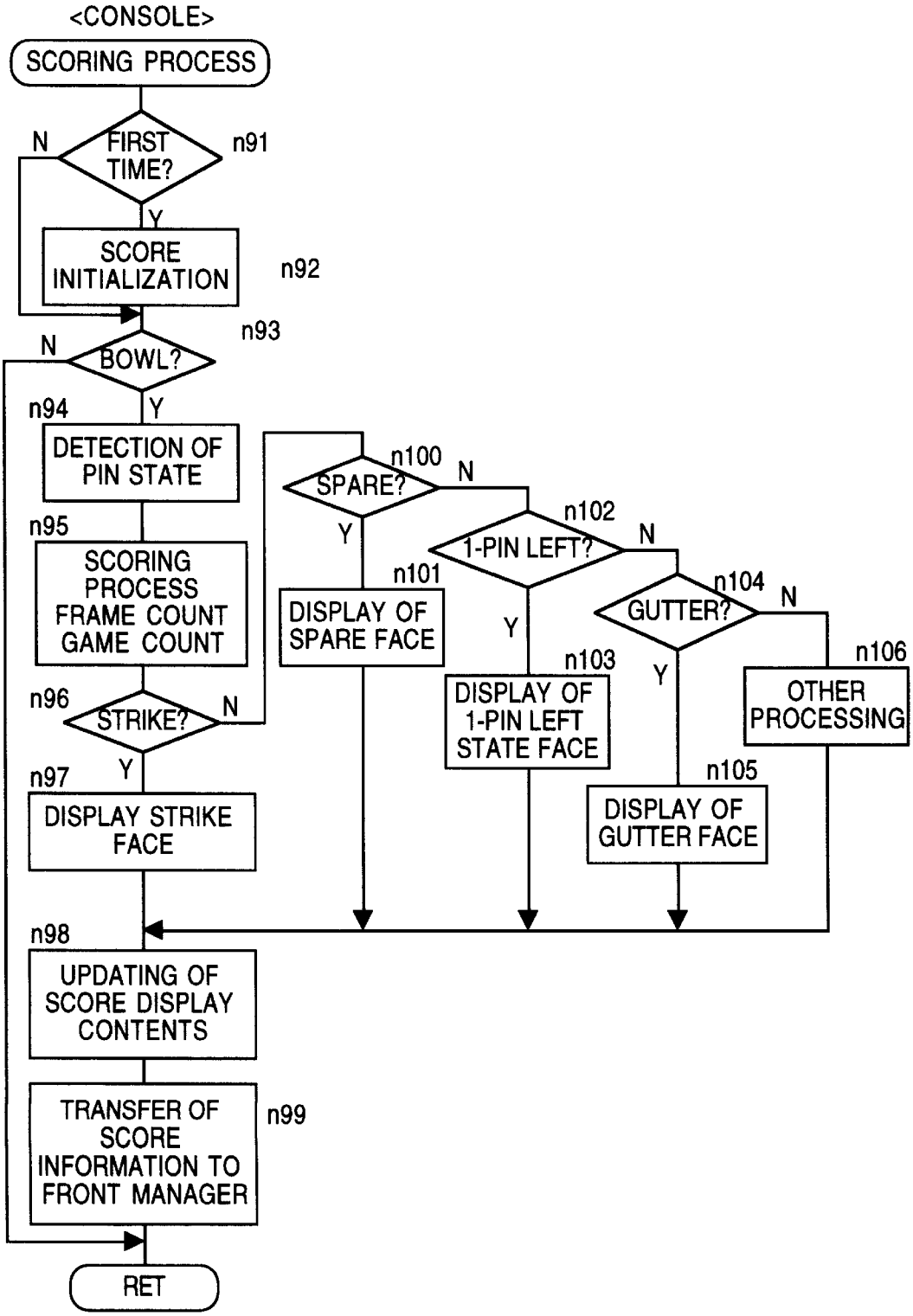
FIG. 20 is a flow chart showing the contents of scoring process in the console.

FIG. 20 is a flow chart showing the procedure for scoring process in the console. First, in the initial state, score is initialized (reset), and a bowl is awaited (n91→n92→n93). Upon detection that a bowl has been done, the resulting pin state is read and, based on this state, a scoring process is performed (n94→n95). Then, an image display responsive to the score result of this time is performed. For example, a display as shown in FIG. 16A is executed upon occurrence of a strike (n96→n97), a display as shown in FIG. 16B is done upon occurrence of a spare (n100→n101), a display as shown in FIG. 16C is done for a one-pin left state (n102→n103), and a display as shown in FIG. 16D is done upon occurrence of a gutter (n104→n105). After that, the score display contents are updated, followed by a return to the score screen (n98). Further, score information is transferred to the front manager (n99).

In this example, various bowler's images are displayed according to the score result after a bowl. However, it is also possible that some bowler's image is displayed at a time point when the bowl of a ball has been detected. It is also possible that some bowler's image is displayed in response to a resulting pin state at a time point when the pin state after a bowl has been detected (before the pin state is reflected on the score). Further, it is also possible that a bowler's image is displayed according to occurrence of an event other than the above. As an example, it may be arranged that another game other than the bowling game, such as slot machine game or sugoroku (a Japanese variety of Parcheesi) is displayed on the screen depending on the result of a bowl or the state of score and, when the game result has come to a specified state, a bowler's image responsive to the state is displayed.

Next, the configuration of a console for bowling according to a fourth embodiment is described with reference to FIGS. 21 to 23.

Figure 21:
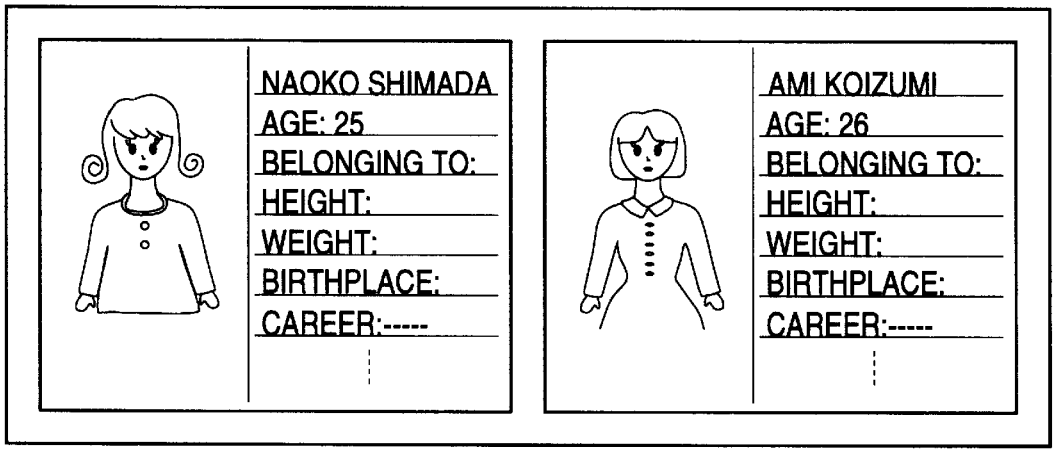
FIG. 21 is a view showing a display example of an overhead CRT according to a fourth embodiment.
Figure 21:
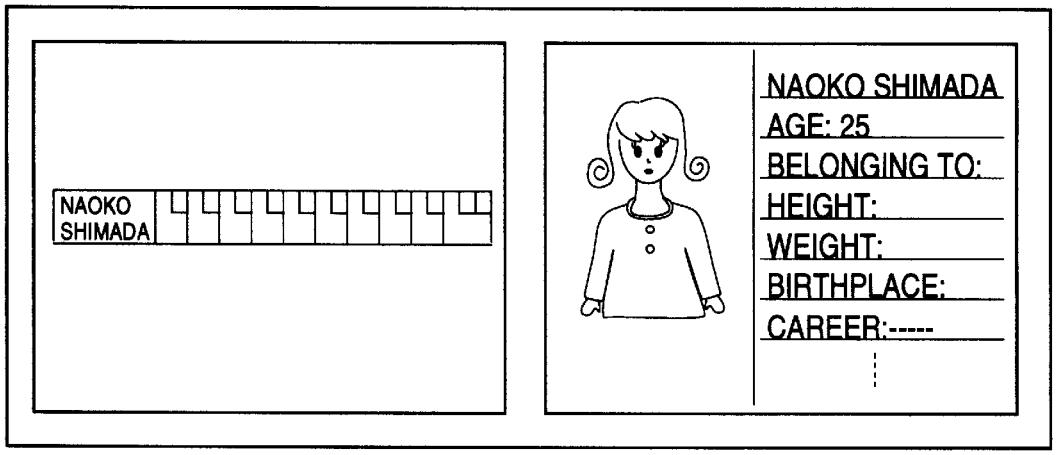

FIG. 21 is a view showing display examples of the overhead CRT. FIG. 21A is an example in which a currently bowling bowler's image and here profile are displayed on the overhead CRT of each lane. FIG. 21B is an example in which one bowler occupies one box (a unit of two lanes treated by one console), as in the professional league, where the score is displayed on one CRT while the bowler's image and profile are displayed on the other CRT.

Figure 22:
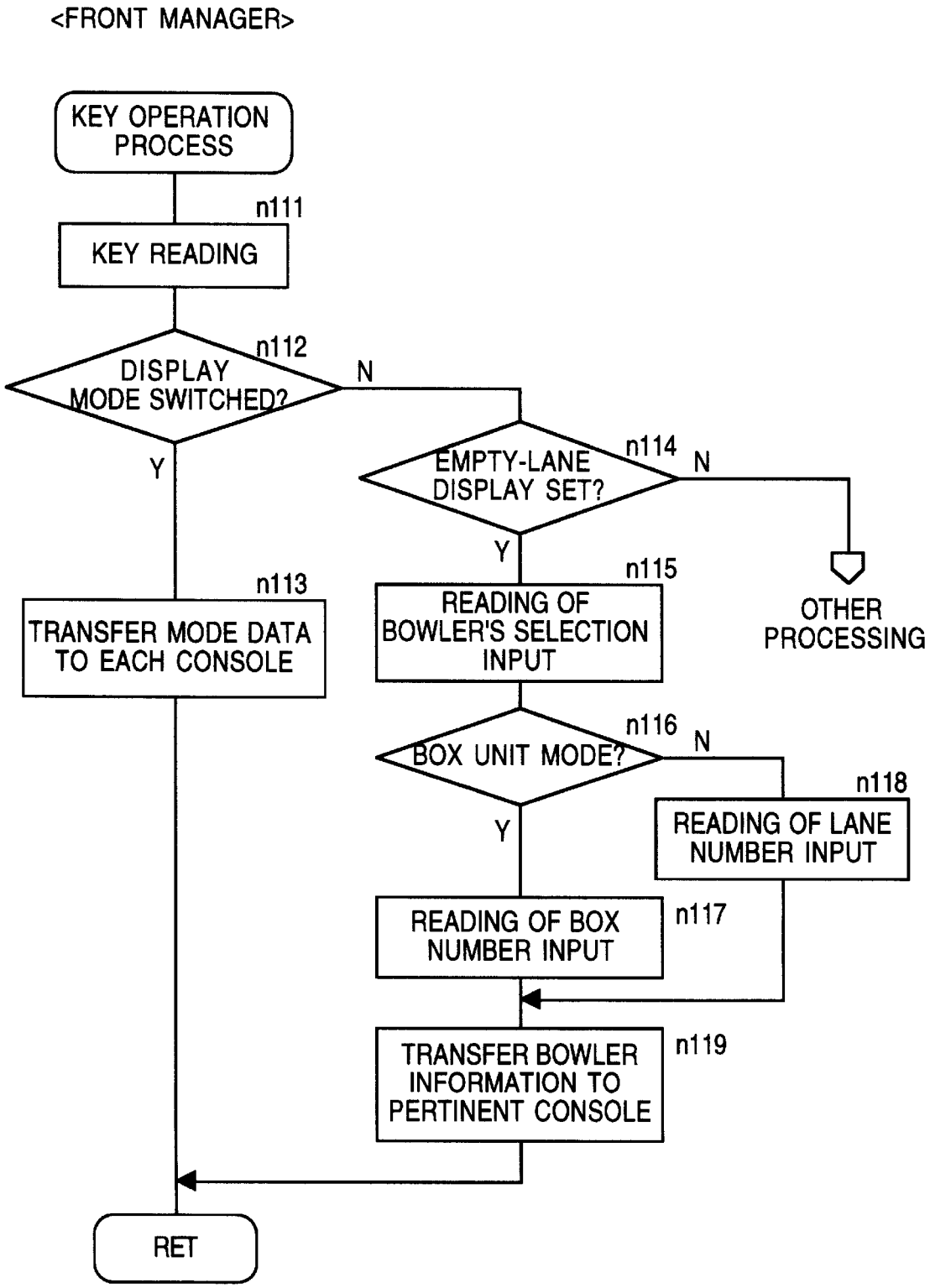
FIG. 22 is a flow chart showing the contents of key operation process in the front manager.

FIG. 22 is a flow chart showing the contents of key operation process in the front manager. First, a key operation is read (n111). Upon a switching operation of the display mode, its display mode data is transferred to each console (n112→n113). The "display mode" includes a mode indicating whether to display the profile of the bowler and another mode indicating, when the profile is displayed, in which state between one state shown in FIG. 21A or another shown in FIG. 21B (hereinafter, referred to as "box unit mode") the display is executed. Also, as shown in FIG. 22, when the setting operation for displaying the bowler's profile onto the overhead CRTs of empty lanes is done, then a selection input of a bowler to be displayed on the CRTs is read (n114→n115). This bowler selection is to be made by selecting out of a member list previously registered for the league tournament, or by designating the number of the lane at which the bowler is actually playing the game. Subsequently, in the case of the box unit mode, an input of a box number is read (n116→n117). In the case of other than the box unit mode, an input of a lane number is read (n118). In this process, without requiring the entry of the box number and the lane number one by one, such a way of entry is also permitted as designating Nos. -, odd or even numbers, or all empty lanes, thus saving the labor for number input. Then, the pertinent bowler's information is transferred to the pertinent consoles (n119). As a result, information as to the bowler who is playing the game at some other lane is displayed on the overhead CRTs of the empty lanes.

Figure 23:
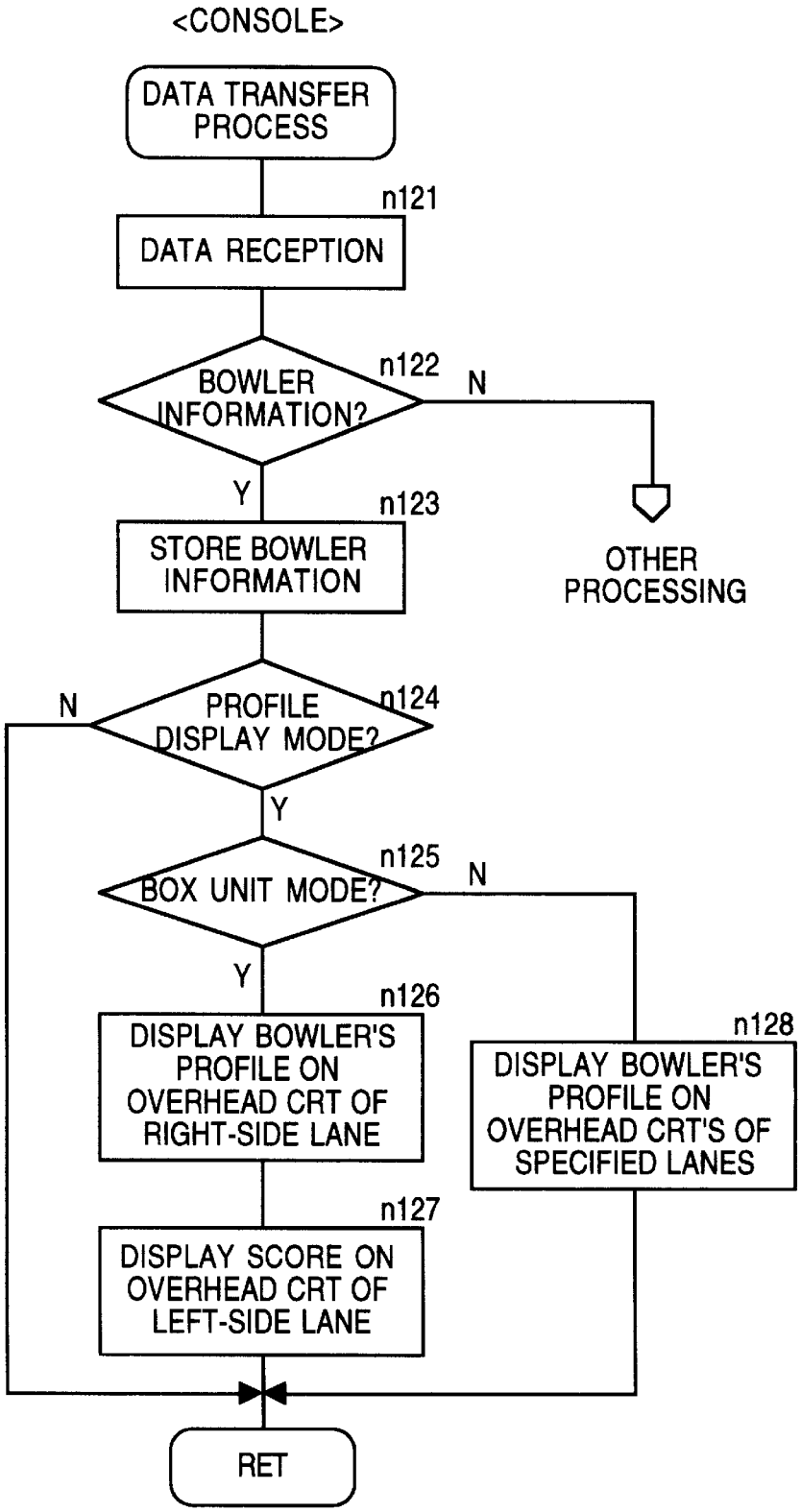
FIG. 23 is a flow chart showing the contents of data transfer process in the console.

FIG. 23 is a flow chart showing the contents of data transfer process in the console. First, data is received from the front manager, where if the data is bowler information, then it is stored (n121→n122→n123). Also, if the display mode of the received data is a combination of the profile display mode and the box unit mode, then the bowler's profile is displayed on the overhead CRT of the right-side lane, while the bowler's current score is displayed on the overhead CRT on the left-side lane, as shown in FIG. 21B (n124→n125→n126→n127). Also, if it is the mode that different bowlers' profiles are displayed on the lanes, respectively, then the bowler's profiles are displayed on the overhead CRTs of specified lanes, respectively, as shown in FIG. 21A (n128).

The configuration of a console for bowling according to a fifth embodiment is described with reference to FIGS. 24 and 25. In this fifth embodiment, a bowler's face (upper half) is shot by using a camera provided in the console and the result is treated as the bowler's image information.

Figure 24:
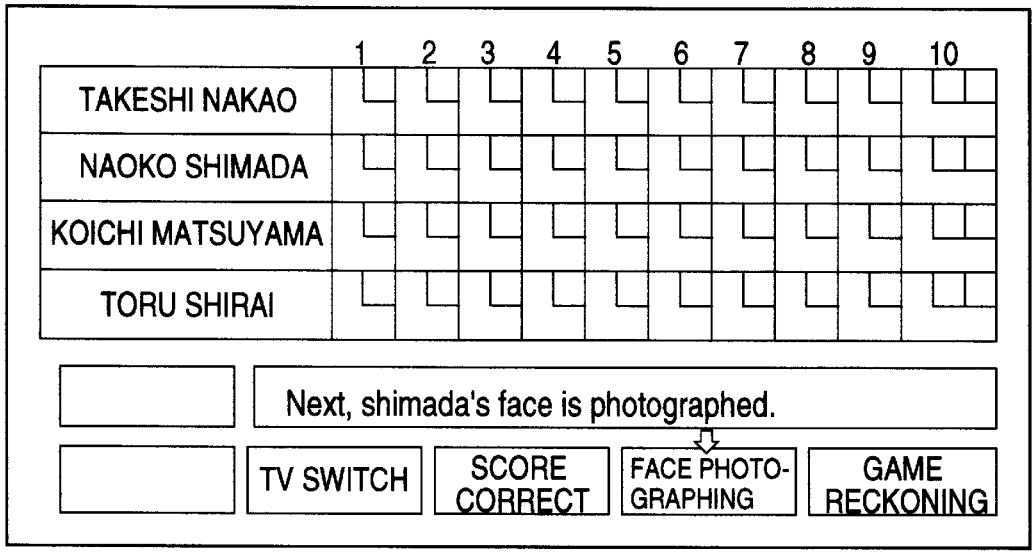
FIG. 24 is a view showing a display example of a console for bowling according to a fifth embodiment.
Figure 24:
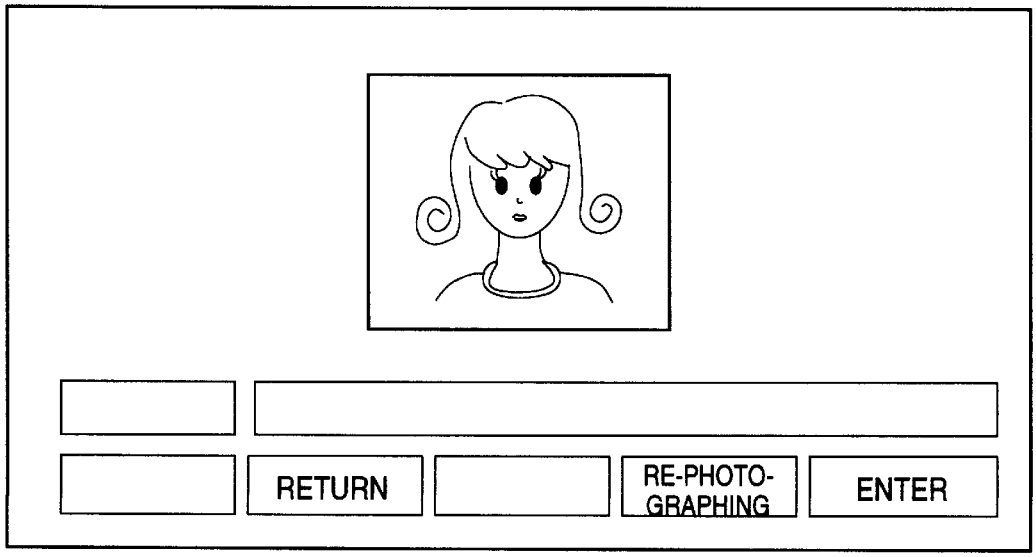

FIG. 24 is a view showing a display example in the console. A guidance display notifying that the bowler's image is taken, where operating the function key for picture taking of the face causes the bowler's image to be displayed as a moving picture as shown in FIG. 24B. Then, operating the enter key here causes the guidance for capturing a still picture to be displayed, and a still picture is captured.

Figure 25:
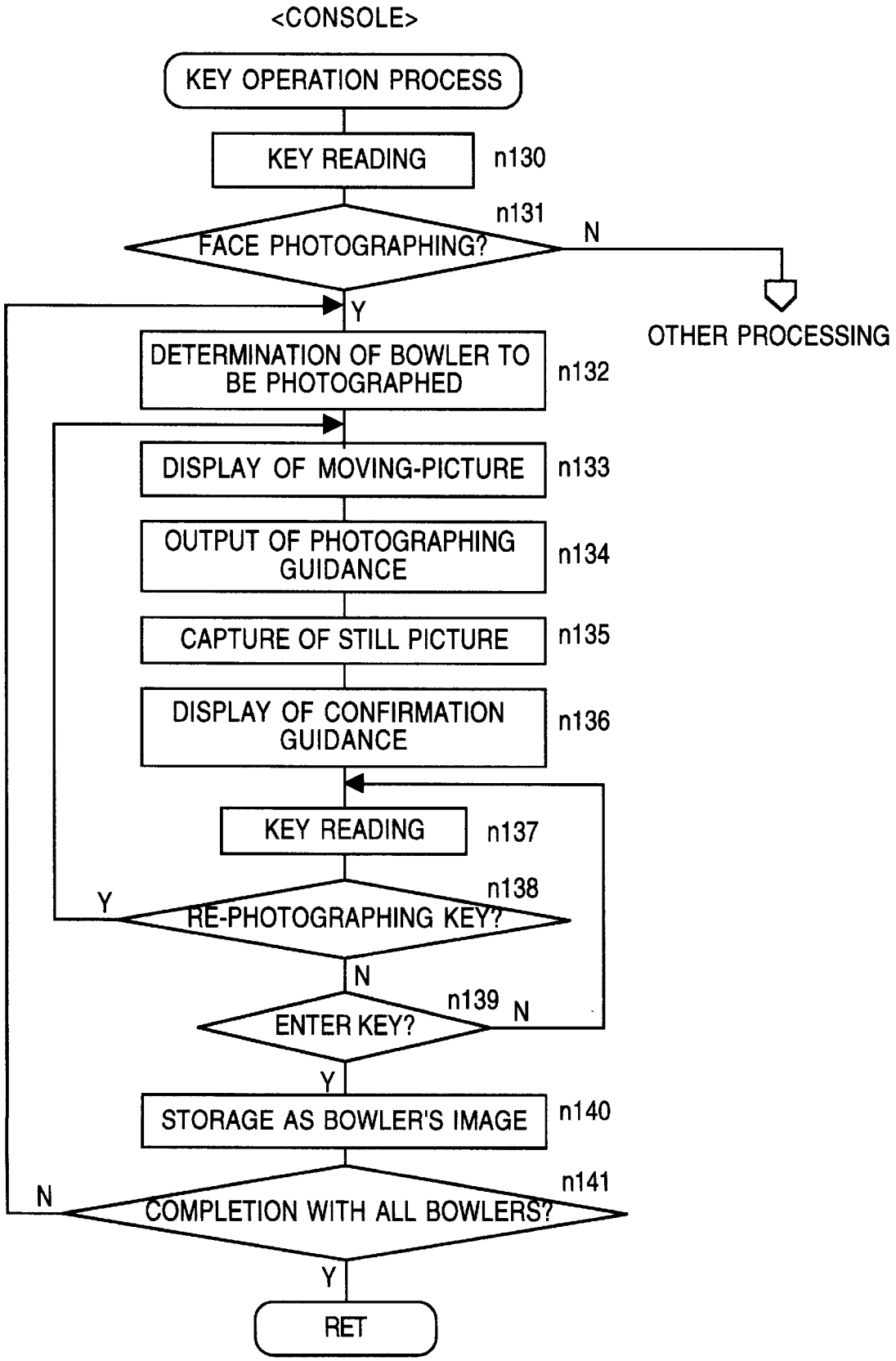
FIG. 25 is a flow chart showing the contents of key operation process in the console.

FIG. 25 is a flow chart showing the contents of bowler's picture taking process in the console. First, the contents of the key operation are read (n131). Upon detection that the face-picture taking key has been operated, a bowler to be shot is determined and a camera image (moving picture) is displayed and superimposed into the score screen (n131→n132→n133). Then, the guidance for actually starting the picture taking process (e.g., "Now shooting! Look at the red light . . . Hold the pose!") is sounded (n134). During this process, the LED 35 shown in FIG. 2 is blinked. Then, the captured still picture is displayed for confirmation (n136). If the ENTER key is operated here, the resulting still picture is stored as the bowler's image information (n137→n138→n139→n140). If the READ-SHOOTING key is operated, then the processing flow returns to the image taking guidance output (n138→n133). These processes are repeated for every bowler in the relevant lane (n141→n132→. . . ).

As described above, according to the present invention, different images can be displayed on the display units, respectively, which are built in or connected to many consoles provided in the bowling alley without the intervention of any video cable. Still, there is no need of laying down any new cable or the like between the host computer and the individual computers.

In particular, by previously setting timing or procedure for reproducing image data, it becomes possible for example, to reproduce commercial images, as appropriate. Thus, the bowling alley can profit from the commercials, and the bowlers can be offered information services, so that the display device contained in or connected to the consoles can be effectively used.

Further, the display devices built in or connected to the consoles of empty lanes can also be effectively used.

Further, because image data is reproduced through operation on the console side, interactive information transfer is enabled. For example, it becomes possible to display commercial images responsive to an operation of selection by the bowler, thus allowing an easy transfer of high-density information, unlike the case in which commercial images are displayed merely in one way continuously.

Further, because image information including bowlers' faces is displayed as the display contents other than the score display on the display device, the bowlers are less bored than when the same character or the like is displayed at all times.

Further, since bowlers' image information is inputted on the console side, such troublesome work as taking pictures of bowlers in their reception process at the front is eliminated, which allows the reception process to be accelerated.

Further, since bowlers' image information stored on the host computer side is inputted via the local area network, it becomes easy to enter the bowlers' image information into the console at any necessary time point.

Further, because image information obtained from modifications of a bowler's original image is used, a wide variety of images can be displayed as the bowler's image, thus making the bowlers more attracted. Moreover, because the image information is only based on one original image, it is not necessary to take images so many times, neither is it necessary to force the bowlers to hold a specified face in picture taking.

What is claimed is:

1. A bowling alley management system comprising console devices provided in each lane and a host computer connected to the console devices via a local area network, each of the console devices comprising:

a pin detecting device for detecting a pin state of pins' positions after a bowl, and counting means for counting a bowling game score from the pin state;

the host computer including a compressed image memory for storing image data subjected to data compression, and transfer means for transferring the image data to any of the console devices via the local area network, wherein the console device includes data expansion means for receiving the image data and expanding the data, and a display device for displaying a reproduction image obtained by the data expansion, wherein the host computer contains a media storage device, moving-picture files are stored within the media storage device, and the host computer is programmable to send the moving-picture files to the console devices for display pursuant to a schedule stored in the host computer.

2. The bowling alley management system as claimed in claim 1, wherein the host computer further includes a reproduction control data memory for storing image reproduction control data which controls a reproduction timing or reproduction procedure for reproducing the image data, and the transfer means of the host computer transfers the compressed image data to any of the console devices via the local area network according to the reproduction timing or reproduction procedure.

3. The bowling alley management system as claimed in claim 2, wherein the transfer means of the host computer transfers the compressed image data to any unused console devices via the local area network.

4. The bowling alley management system as claimed in claim 1, wherein the transfer means of the host computer transfers the compressed image data to any unused console devices via the local network.

5. The bowling alley management system as claimed in claim 1, wherein the compressed image memory of the host computer stores a plurality of the compressed image data, and each of the console devices comprises a selection switch for selecting one of the image data.

6. The bowling alley management system as claimed in claim 1, wherein the console device further comprises a video camera for capturing an image forward of the console, and wherein an image of a bowler's face to be stored in a bowlers' image memory is obtained by the video camera.

7. The bowling alley management system as claimed in claim 1, wherein the console device further includes:

a bowler's image memory for storing a bowler's image information including an image of a bowler's face;

display means for reading and displaying the bowler's image information based on an occurrence of a specified event during a bowling game, wherein the image of the bowler's face stored in the bowler's image memory is a modification of a bowler's original image.

* * * * *